US007160028B1

(12) United States Patent
Linday

(10) Patent No.: US 7,160,028 B1
(45) Date of Patent: Jan. 9, 2007

(54) CONVERTIBLE TOTE BAG

(76) Inventor: Nancy L. Linday, 170 Park Row #18E, NYC, NY (US) 10038

( * ) Notice: Subject to any disclaimer, the term of this patent is extended or adjusted under 35 U.S.C. 154(b) by 0 days.

(21) Appl. No.: 10/417,589

(22) Filed: Apr. 17, 2003

Related U.S. Application Data

(63) Continuation-in-part of application No. 09/896,477, filed on Jun. 29, 2001, now abandoned, which is a continuation-in-part of application No. 09/493,884, filed on Jan. 28, 2000, now abandoned.

(60) Provisional application No. 60/117,512, filed on Jan. 28, 1999.

(51) Int. Cl.

| | |
|---|---|
| ***B65D 30/00*** | (2006.01) |
| ***B65D 33/06*** | (2006.01) |
| ***A45F 4/00*** | (2006.01) |
| ***A45C 9/00*** | (2006.01) |
| ***A45C 13/26*** | (2006.01) |

(52) U.S. Cl. ..... 383/4; 383/6; 383/17; 383/18; 224/579; 224/578; 224/153; 190/1; 150/108

(58) Field of Classification Search ..... 383/4, 383/6, 13, 17, 18; 224/579, 153, 627, 631, 224/657, 578; 190/1, 18 A; 150/107, 108
See application file for complete search history.

(56) References Cited

OTHER PUBLICATIONS

ITW Nexus, The Cutting Edge (catalog) pp. 1-22 plus insert.
ITW Waterbury Buckle, catalog, pp. 1-23.

*Primary Examiner*—Robin A. Hylton

(57) ABSTRACT

The convertible tote bag of the present invention comprises a container of any width, depth and length that can be either closed or open at the top, with or without exterior or interior pockets, with two carrying straps of adjustable size that are permanently attached on one end on opposite sides of the bag diagonally across from each other. The convertible tote bag can be carried in the hand or on the shoulder when the end of each strap that is not permanently attached to the bag is selectively attached to the attachment mechanism on the same side of the bag. In this invention there are two ways for the convertible tote bag to be worn as a backpack. One way to wear the convertible tote bag as a backpack is to thread the ends of each strap that are not permanently attached to the bag through the rings or apertures attached to the top of the opposite bag wall and extend the straps down the back wall to selectively attach to the attachment mechanisms permanently affixed on the lower part of the back wall of the bag. A second way to wear the convertible tote bag as a backpack is to selectively attach the end of each strap that is not permanently attached to the bag to the attachment mechanism on the opposite side of the bag.

14 Claims, 34 Drawing Sheets

21
22
20
24
22'
100
24'
12
102
10
18
40
102'
100'
14
12
104
104'
106
106'

21
22
20
24
22'
100
24'
276
202
10
16
44
34
218
250
275
240
202'
100'
28
28
28'
28'
14
12
104
104'
204
204'
203
203'

20
21
50
51
60'
16
70'
74
41'
78
41
28'
28'
10
28
28
12

CONVERTIBLE TOTE BAG

CROSS-REFERENCES TO RELATED APPLICATIONS

This application is a Continuation-In-Part of patent application Ser. No. 09/896,477 filed Jun. 29, 2001, now abandoned which is a Continuation-In-Part of patent application Ser. No. 09/493,884 filed Jan. 28, 2000, now abandoned which is entitled to the benefit of Provisional Patent Application Ser. No. 60/117,512, filed Jan. 28, 1999 now abandoned; all are herein incorporated by reference.

FIELD OF INVENTION

This invention relates to convertible bags. In particular, the invention relates to convertible bags with interchangeable handles.

DISCUSSION OF PRIOR ART

Tote bags of varying width, depth and length, both closed and open on top, are well known and popular items in the women's accessory market and also in the premium and ad specialty market, where they are distributed to men as well as women. These tote bags, which can be wider than both a woman's and a man's back, can become very heavy once filled to capacity. When carried on one side of the body, either in the hand or on the shoulder, these heavy tote bags shift the posture of the user out of proper alignment. It is important for the user to be able to wear the tote bag on his or her back to maintain proper posture.

Various bags having detachable and interchangeable components are known in the prior art and provide for many configurations of the components.

U.S. Pat. No. 1,189,480 to Pomper teaches improvements to shopping bags. There is no mechanism in this invention for the shopping bag to be worn as a backpack.

U.S. Pat. No. 1,370,636 to Dwyer teaches a convertible satchel with a detachable carrying strap. This carrying strap is completely removable from the satchel and can therefore be lost easily.

U.S. Pat. No. 2,723,696 to Kase teaches rigid foundation handbags with interchangeable outer components. Pliable fabric cannot be used with this invention. The handles are not adjustable in length. A bag with an open top cannot be used with this invention.

U.S. Pat. No. 3,297,119 to Viol teaches a tote bag of the shoulder type which is quickly and easily convertible into an infant's seat of the breeches-buoy type. In this invention, the tote bag converts to an infant's seat being adapted to be carried by hand, or to be attached to the seat of an automobile or mounted on a conventional chair to convert it to an infant's highchair. There is no mechanism in this invention for the tote bag to be worn as a backpack.

U.S. Pat. No. 3,346,155 to Oechsle teaches a carrier for books and small articles. The usefulness of this carrier when worn as a backpack is limited by the width of the container in this invention. With a container whose width is greater than the width of the wearer's back, the looped strap arrangement will fall off the wearer's shoulders.

U.S. Pat. No. 3,802,613 to Droeger teaches an article of luggage which can be carried by the handles as a satchel or on the back as a backpack. A bag with an open top cannot be used with this invention.

U.S. Pat. No. 3,938,716 to Jackson et al. teaches a bag that can be used as a pannier on a cycle or a backpack. This invention does not teach a bag that can be carried as a tote bag.

U.S. Pat. No. 4,125,212 to Luc Courchesne a portable utility bag adapted to vary its volume that can be used as a handbag, shoulder bag or backpack. A bag with an open top cannot be used with this invention.

U.S. Pat. No. 4,153,092 to Haslam teaches a bag with a carrying strap arrangement that cooperates to convert the bag to and from handbag and shoulder bag, backpack, and saddle bag. The usefulness of the backpack in this invention is limited by the width of the bag. A very wide bag such as a tote bag would fall off the wearer's back when worn as a backpack according to the teaching of this patent.

U.S. Pat. No. 4,810,102 to Norton teaches a specially adapted sport bag that can be utilized as either a waist-, shoulder-, or backpack. In order for this bag to function as a backpack, the bag must be of the type that is closed at the top opening. A bag with an open top would not work with this invention.

U.S. Pat. No. 4,240,480 to Strobel teaches a bag having the dual purposes of hanging on the back of a chair and being held in the hand. This invention does not teach the use of the bag as a backpack.

U.S. Pat. No. 4,273,274 to Freistadt teaches a convertible handbag and backpack which includes a bag body to which a pair of carrying straps are secured. The criss-crossed position in which the carrying straps are placed when this bag is to be carried in the user's hand make for a very uncomfortable handle in which the edges of the criss-crossed straps press into the wearer's hand. In addition, the length of these straps is not adjustable, making it necessary to either have short strap lengths that will not fit on large backs over heavy clothing or to have long strap lengths that will make the bag touch the floor when carried in the hand of a short person.

U.S. Pat. No. 4,856,570 to Rushing et al teaches a multi-use handbag having a main storage body, at least one handle and at least one locking flap secured to one or more corners of the main storage area to an engagement member disposed along the lateral side of the handbag. The handles in this patent are completely removable, making it possible for them to be lost. In addition, the length of these handles is not adjustable. As a result, if short handles are used they will not fit on large backs over heavy clothing, and if long handles are used the bag will touch the floor when carried in the hand of a short person. According to the teachings of this patent, a very wide bag such as a tote bag would fall off the wearer's back when the handles are attached to the corners of the bag so that it may be worn as a backpack.

U.S. Pat. No. 4,989,656 to Derfler teaches a shoulder bag that, once closed, will remain closed even if substantial weight is carried in the bag. This patent does not teach the art of using this bag as a backpack.

U.S. Pat. No. 5,407,111 to Lanouette et al. teaches an improved sports accessory bag with straps which are convertible for use either with a bar on stationary exercise apparatus or for use as a portable accessory bag. This patent does not teach the art of using this bag as a backpack.

U.S. Pat. No. 5,415,332 to Kliot teaches a multimode traveling bag which can be carried as a hand carrying bag, a backpack, shoulder bag or over the head bag. In order that this invention be worn as a backpack, permanently attached backpack straps must be fixed to the bag. These backpack straps cannot be removed and therefore detract from the value of the bag as a standard bag. In addition, in order for these backpack straps to function properly, the bag must be of the type that is closed at the top opening. A bag with an open top would not work with this invention.

U.S. Pat. No. 5,577,652 to Cooper teaches a convertible backpack that can be worn as a shoulder bag. This invention has separate handles permanently affixed to each side of the bag so that is may be carried as a satchel. A bag with an open top would not work with this invention.

U.S. Pat. No. 5,743,448 to Tsai teaches a raincoat concealing backpack. This patent does not teach the art of using this backpack as a shoulder bag or satchel to be carried in the hand.

U.S. Pat. No. 5,950,893 to Heggeland teaches a flexible tote strap for luggage and other portable articles. This patent does not teach the art of using this tote strap to wear luggage as a backpack.

U.S. Pat. No. 5,957,354 to Mentken teaches a low cost backpack. This patent does not teach the art of using this backpack as a shoulder bag or satchel to be carried in the hand.

U.S. Pat. No. 5,967,390 to Goryl teaches a bait bag that can be inflated and fastened to the waist of the fisherman so as to act as a buoyancy aid. This patent does not teach the art of using this bag as a backpack.

U.S. Pat. No. 6,092,702 to Cassidy, IV, teaches a multipurpose bag. A bag with an open top would not work with this invention.

U.S. Pat. No. 6,161,738 to Norris teaches a combination container that can concurrently be used as a ballistic shield. A bag with an open top would not work with this invention.

U.S. Pat. No. 6,220,493 to Iijima et al. teaches a multiway bag and a length-adjustable strap for carrying the bag. This adjustable strap is detachable from the bag at both ends and can thus be easily lost.

U.S. Pat. No. 6,286,461 B1 to Martz teaches a portable animal carrier that can be worn as a backpack, a shoulder bag or tote bag. A bag with an open top would not work with this invention. The criss-crossed position in which the carrying straps are placed when this bag is to be carried in the user's hand make for a very uncomfortable handle in which the edges of the crisscrossed straps press into the wearer's hand.

U.S. Pat. No. 6,311,884 to Johnson teaches a dual strap system by which a utility bag can be converted into a backpack. The dual strap system is detachable from the bag at both ends and can thus be easily lost.

German Patent No. 808 759 does not teach the art of converting a satchel to a backpack.

French Patent No. 968,005 to Alkan teaches a satchel with handles that converts to a day book. This invention does not teach the art of converting the satchel to a backpack.

SUMMARY OF THE INVENTION

The convertible tote bag of the present invention comprises a container of any width, depth and length that can be either closed or open at the top, with or without exterior or interior pockets, with two carrying straps of adjustable size that are permanently attached on one end on opposite sides of the bag diagonally across from each other. The convertible tote bag can be carried in the hand or on the shoulder when the end of each strap that is not permanently attached to the bag is selectively attached to the attachment mechanism on the same side of the bag. In this invention there are two ways for the convertible tote bag to be worn as a backpack. One way to wear the convertible tote bag as a backpack is to thread the ends of each strap that are not permanently attached to the bag through the rings or apertures attached to the top of the opposite bag wall and extend the straps down the back wall to selectively attach to the attachment mechanisms permanently affixed on the lower part of the back wall of the bag. A second way to wear the convertible tote bag as a backpack is to selectively attach the end of each strap that is not permanently attached to the bag to the attachment mechanism on the opposite side of the bag.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention. Any known latching mechanisms and removable attaching means used for bags, handbags, tote bags and backpacks including, but not limited to all those described in both the catalog "The Cutting Edge" by ITW Nexus and the catalog by ITW Waterbury Buckle, are hereby incorporated by reference. The full range of designs used in the art of making tote bags as well as the full range of methods used for closing the top of the tote bag can be used with the present invention, including latching and attachment mechanisms used in the art for closing flaps and internal or external pockets. The tote bag may be constructed of any suitable material including, but not limited to, any fabric material, plastic, leather, or synthetic material.

Figure 1:
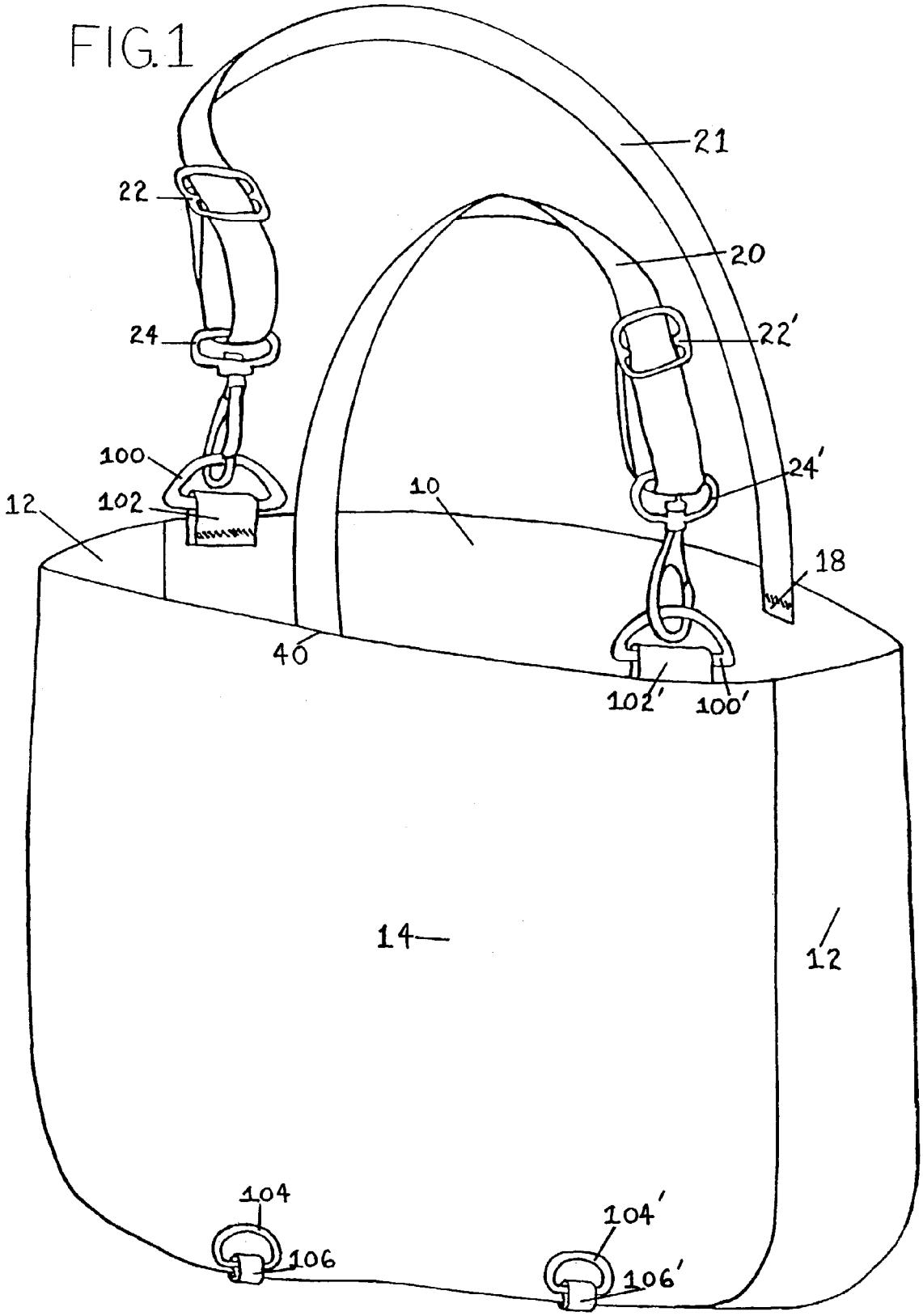
FIG. 1 is a view of the first embodiment of the convertible tote bag assembled as a bag.

With reference to the first embodiment of the invention as shown in FIG. 1, the front 10 of the open tote bag has a ring 100 and strap of material 102 permanently attached to the inside top of the front 10 of the bag in which a selectively attachable mechanism 24 is attached. The selectively attachable mechanism shown in FIG. 1 is a swivelhook, but all kinds of snaphooks can be used in its place in all the embodiments that show the use of the swivelhook. The handle 21 is permanently attached to the top of the inside of the front of the tote bag 10 at position 18 located towards the opposite side of the top of the front of the tote bag 10 from the ring 100 and strap of material 102. This handle 21 is placed through a slider 22 as well as the selectively attachable mechanism 24 so that the length of the handle can be adjusted. The back of the tote bag 14 has a ring 100' and strap of material 102' permanently attached to the inside top of the back 14 of the bag in which a selectively attachable mechanism 24 is attached. The handle 20 is permanently attached to the top of the inside of the back of the tote bag 14 at position 40 located towards the opposite side of the top of the back of the tote bag 14 from the ring 100' and strap of material 102'. This handle 20 is placed through a slider 22' as well as the selectively attachable mechanism 24' so that the length of the handle can be adjusted. Ring 100 and strap of material 102 located on the front 10 of the tote bag is located opposite permanent attachment of the handle 40 on the back of the tote bag 14. Permanent attachment of the handle 18 on the front of the top of the tote bag 10 is located opposite ring 100' and straps of material 102' located on the top of the back of the tote bag 14.

In addition there is a ring 104' with a strap of material 106' permanently attached to the bottom of the back 14 of the tote bag underneath the ring 100' and strap of material 102' permanently attached to the inside top of the back 14 of the bag, and another ring 104 with a strap of material 106 permanently attached to the bottom of the back 14 of the tote bag underneath permanent attachment 40 of handle 20 at the inside top of the back 14 of the tote bag. In the first embodiment, ring 100 and ring 100' can be of any shape but must be large enough for the swivelhooks 24 and 24' and the slider mechanisms 22 and 22' to thread through inside. Ring 104 and ring 104' can be of any shape and must only be large enough for the swivelhooks 24 and 24' to latch into. FIG. 1 shows the first embodiment of the present invention assembled as a tote bag.

Figure 2:
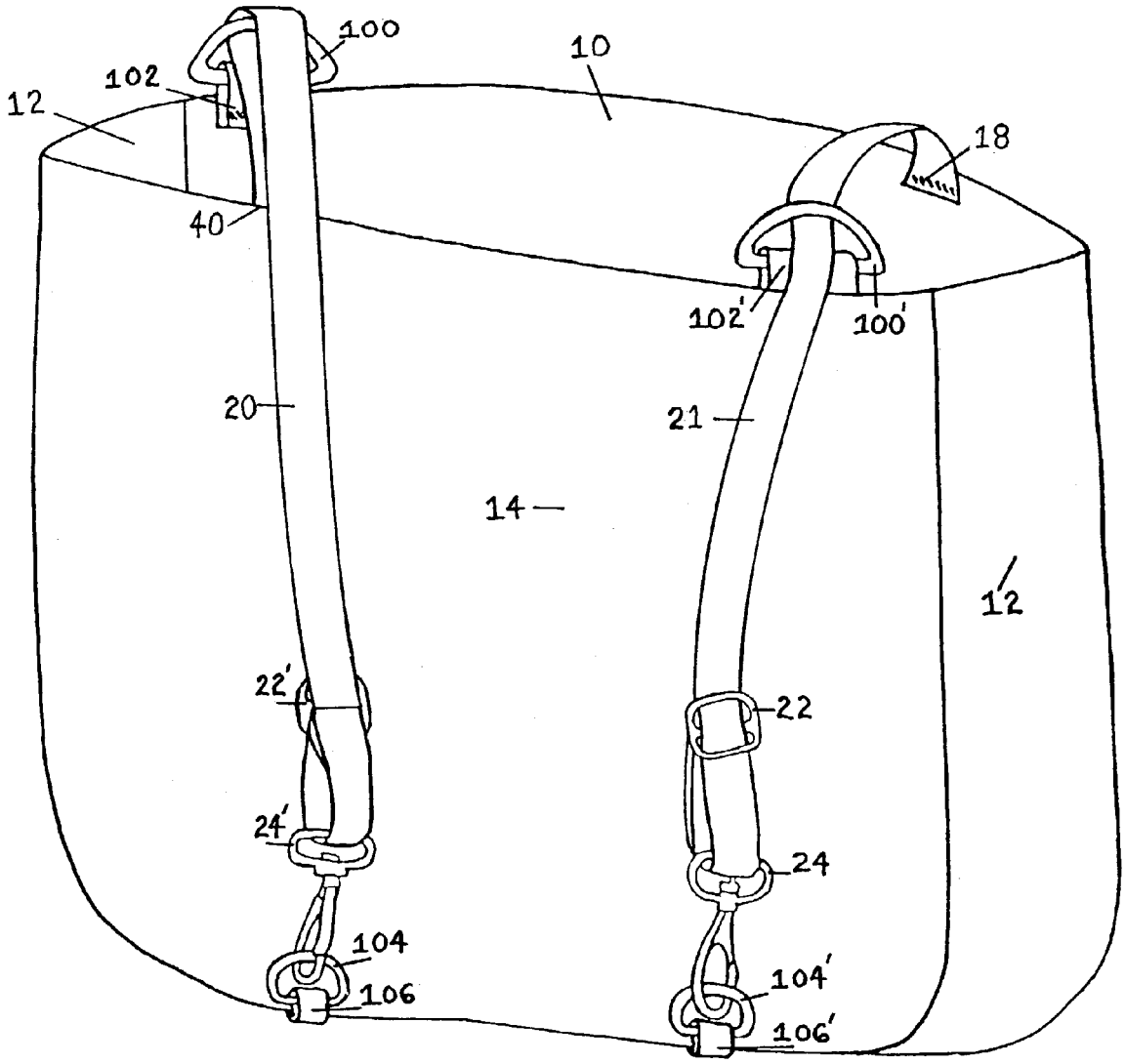
FIG. 2 is a view of the first embodiment of the convertible tote bag assembled as a backpack.

FIG. 2 shows the first embodiment of the present invention assembled as a backpack. In the first embodiment, the swivelhook attachment mechanism 24' and the slider 22' on handle 20 permanently attached to the top of the inside of the back 14 of the tote bag at position 40 extend over the top of the bag, thread inside ring 100, then extend back over the top of the tote bag down the back 14 of the bag to the point where the swivelhook 24' latches into ring 104 permanently attached to the bottom of the bag with strap of material 106. The swivelhook attachment mechanism 24 and the slider 22 on handle 21, permanently attached to the top of the inside of the front 10 of the tote bag at position 18, extend over the top of the bag, thread inside ring 100' permanently attached to the top of the inside of the back 14 of the tote bag, and then extend freely down the back 14 of the bag to the point where swivelhook 24 latches into ring 104' permanently attached to the bottom of the bag with strap of material 106. The two handles thus positioned form two loops that allow the handles to be worn over the shoulders and the tote bag to be worn as a backpack.

Figure 15:
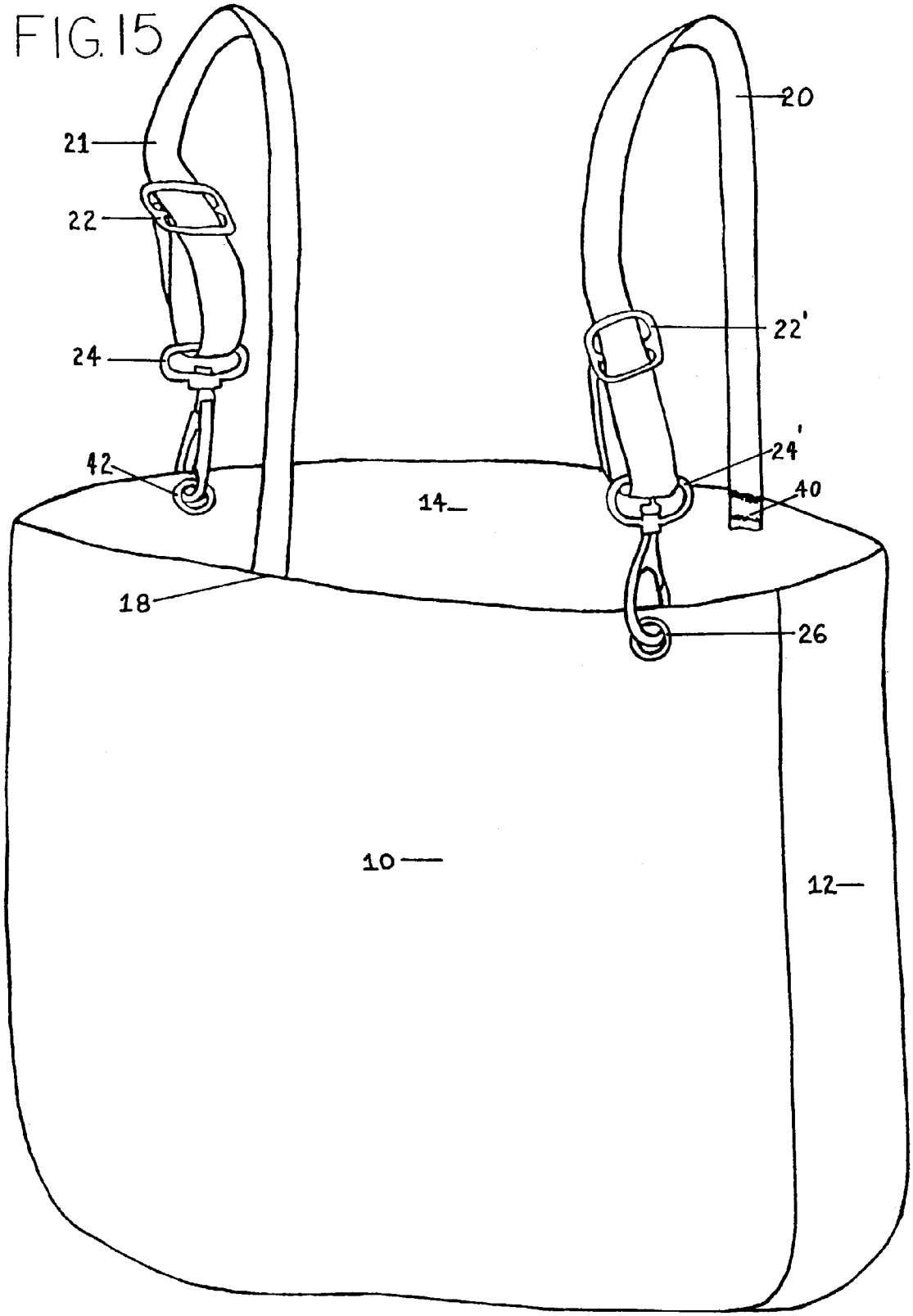
FIG. 15 is a view of the eleventh embodiment of the convertible tote bag assembled as a backpack.

The first embodiment can also be worn as a backpack by arranging the straps to make loops as shown in FIG. 15.

Figure 3:
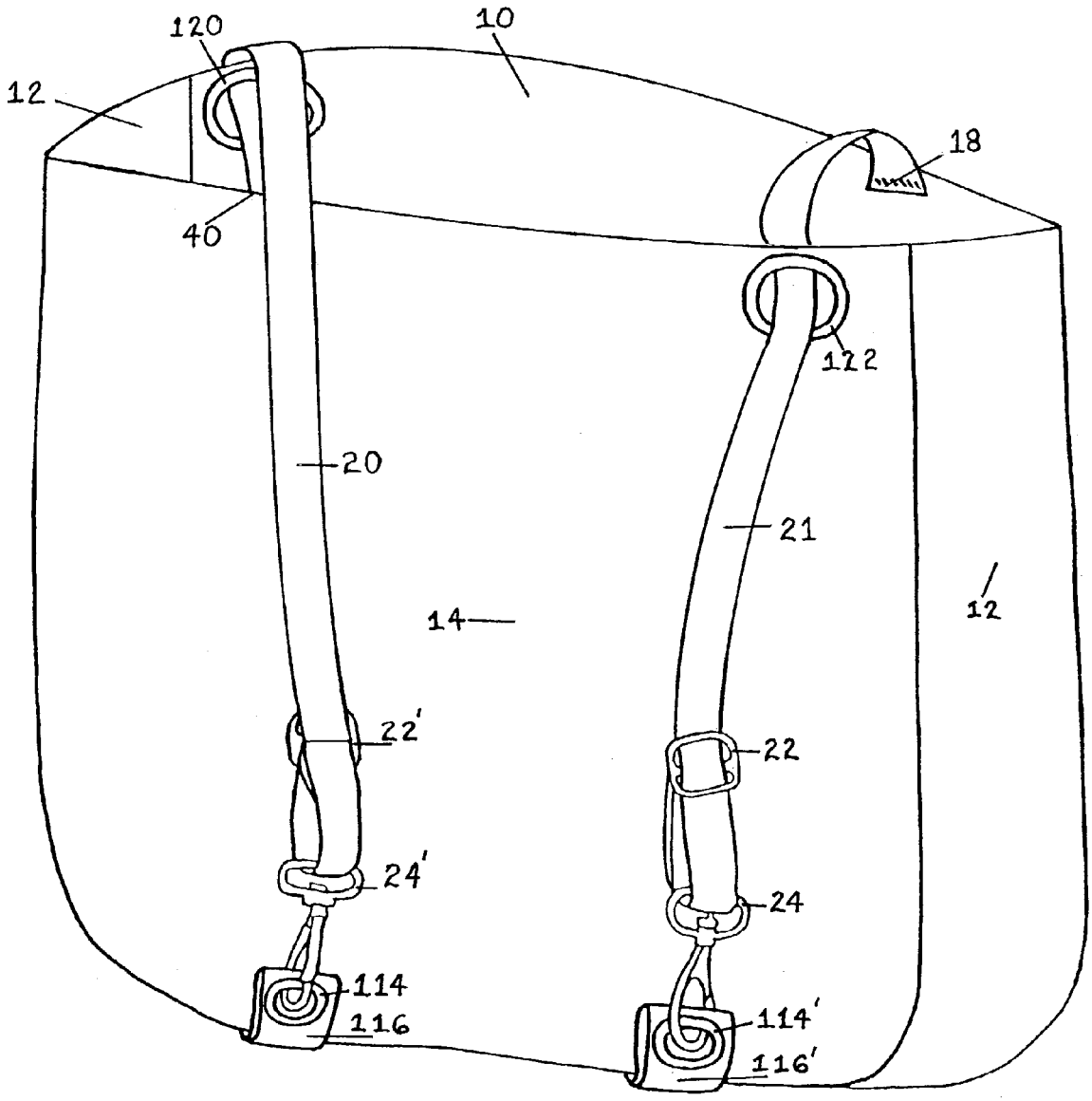
FIG. 3 is a view of the second embodiment of the convertible tote bag assembled as a backpack

FIG. 3 shows the second embodiment of the present invention. The second embodiment also shows an open bag, and is the same as the first embodiment shown in FIG. 2 with two differences. First, ring 104 with strap of material 106 and ring 104' with strap of material 106' are replaced with grommets 120 and 122, respectively. Grommets 120 and 122 are permanently affixed to the top of the bag in the same position as ring 104 and ring 104', and must be large enough for the swivelhooks 24 and 24' and the slider mechanisms 22 and 22' to thread through inside. Second, grommet 114 permanently affixed in strap of material 116 is permanently affixed in the position on the back 14 of the tote bag at the bottom where ring 104 with strap of material 106 is permanently affixed in the first embodiment, and grommet 114' permanently affixed in strap of material 116' is permanently affixed in the position of ring 104' with strap of material 106' in the first embodiment. FIG. 3 shows the second embodiment assembled as a backpack in the same manner as the first embodiment in FIG. 1, where the two handles are positioned to form two loops that selectively attach to the bottom of the back 14 of the tote bag, thus allowing the handles to be worn over the shoulders and the tote bag to be worn as a backpack.

The second embodiment can also be worn as a backpack by arranging the straps to make loops as shown in FIG. 15. The second embodiment can be worn as a tote bag, either carried in the hand or on the shoulder, by arranging the straps as shown in FIG. 1 for the first embodiment.

Figure 4:
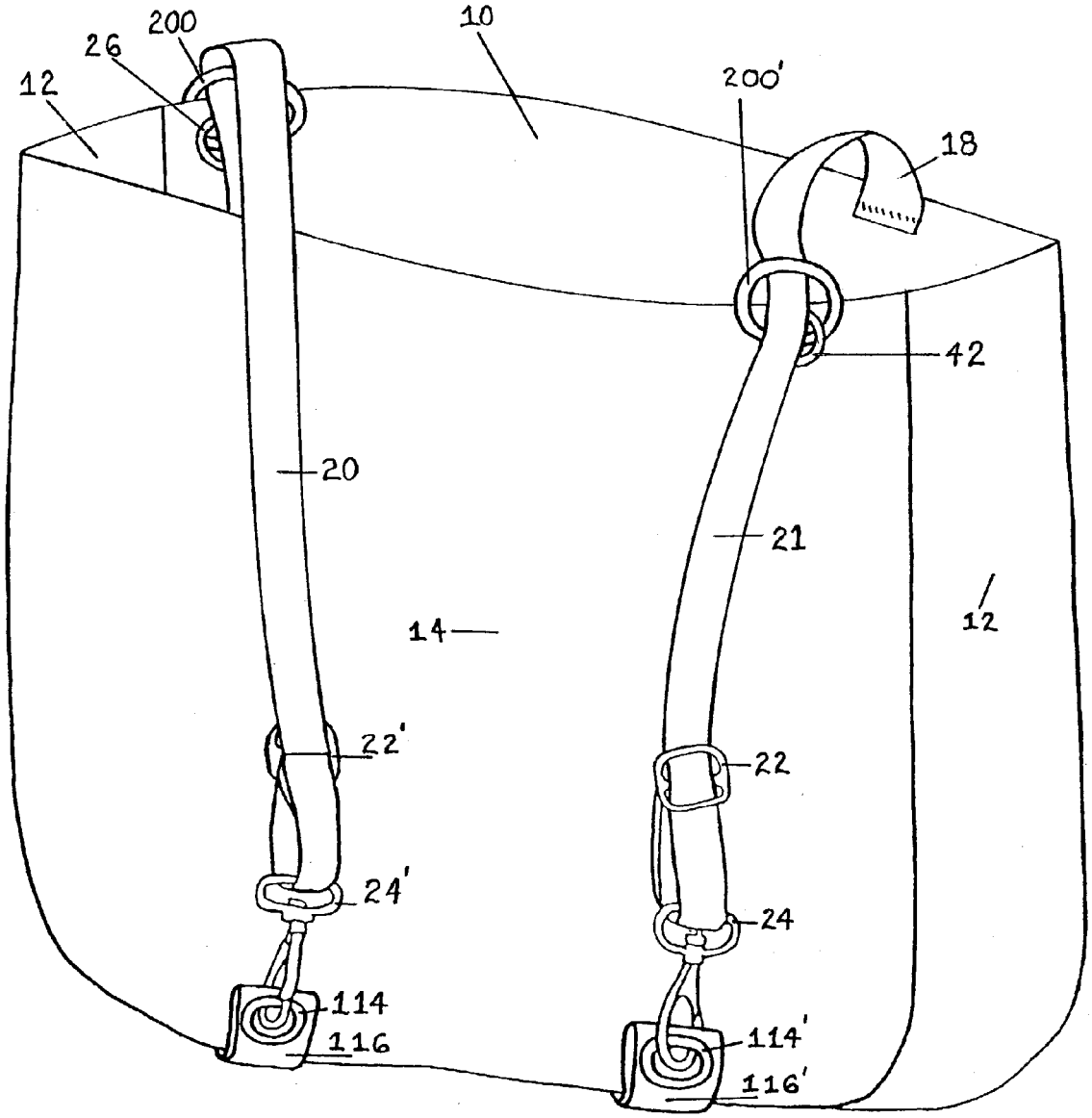
FIG. 4 is a view of the third embodiment of the convertible tote bag assembled as a backpack.

FIG. 4 shows the third embodiment of the present invention. The third embodiment is the same as the second embodiment shown in FIG. 3 except that grommets 120 and 122 are replaced with smaller grommets 26 and 42, respectively, and rings 200 and 200', which are large enough for the swivelhooks 24 and 24' and the slider mechanisms 22 and 22' to thread through inside, are permanently affixed through them. FIG. 4 shows the third embodiment assembled as a backpack in the same manner as the first embodiment in FIG. 1, where the two handles are positioned to form two loops that selectively attach to the bottom of the back 14 of the tote bag, thus allowing the handles to be worn over the shoulders and the tote bag to be worn as a backpack.

The third embodiment can also be worn as a backpack by arranging the straps to make loops as shown in FIG. 15. The third embodiment can be worn as a tote bag, either carried in the hand or on the shoulder, by arranging the straps as shown in FIG. 1 for the first embodiment.

Figure 5:
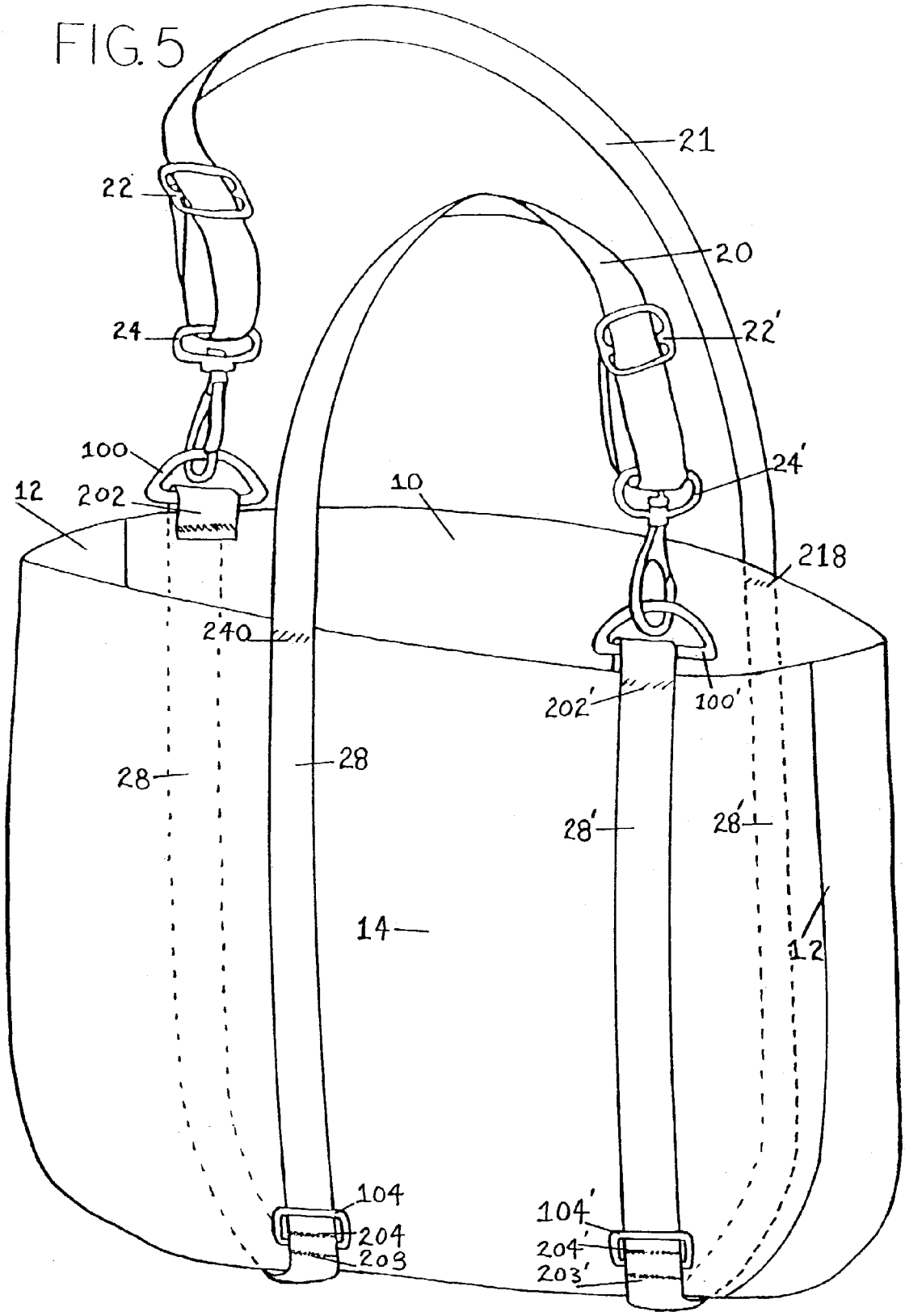
FIG. 5 is a view of the fourth embodiment of the convertible tote bag assembled as a bag.

FIG. 5 shows the fourth embodiment of the present invention. The fourth embodiment shows an open bag. It is the same as the first embodiment shown in FIG. 1 with the exception that in the fourth embodiment strap of material 28 permanently attaches ring 100 to the top of the front of the bag 10 at position 202 in place of strap of material 102 and is permanently attached to the outside of the front 10 of the bag from position 202 down the outside of the front 10 of the bag, across the outside of the bottom of the bag, and up the outside of the back 14 of the bag where ring 104 is threaded through it and permanently attached to the back of the bag 14 close to the bottom of the bag with stitching through the strap of material 28 at positions 203 and 204 on the bottom and the top sides of the ring 104. Strap of material 28 is permanently attached to the outside of the back 14 of the bag up to the top opening where it is permanently attached at position 240, at which point it extends freely from the top of the outside of the bag to become handle 20. The section of the strap of material 28 from permanent attachment point 240 to position 202 is considered the further end of the strap (unnumbered). The section of the strap of material 28 from permanent attachment point 240 to swivel hook 24' is considered the free end of the strap (unnumbered). Strap of material 28' permanently attaches ring 100' to the top of the back 14 of the bag at position 202' in place of strap of material 102' and is permanently attached to the outside of the back 14 of the bag from position 202' down the outside of the back 14 of the bag where ring 104' is threaded trough it and permanently attached to the back 14 of the bag close to the bottom of the bag with stitching through the strap of material 28' at positions 203' and 204' on the bottom and the top sides of the ring 104'. Strap of material 28' is permanently attached across the outside of the bottom of the bag and up the outside of the front 10 of the bag where it is permanently attached to the top of the outside of the front 10 of the bag at position 218, at which point it extends freely from the top of the outside of the bag to become handle 21. The section of the strap of material 28' from permanent attachment point 218 to position 202' is considered the further end of the strap (unnumbered). The section of the strap of material 28' from permanent attachment point 218 to swivel hook 24 is considered the free end of the strap (unnumbered). These straps of material can be made of a wide variety of materials, including, but not limited to, fabric, webbing, leather, plastic or various synthetic fabrics. FIG. 5 shows the fourth embodiment of the present invention assembled as a tote bag.

The fourth embodiment can be assembled as a backpack in the same manner as the first embodiment as shown in FIG. 2. When the fourth embodiment is assembled as a backpack, the swivelhook attachment mechanism 24' and the slider 22' on handle 20, an extension of strap of material 28 permanently attached to the outside of the back 14 of the tote bag to position 240, extend over the top of the bag, thread inside ring 100, then extend back over the top of the tote bag down the back 14 of the bag to the point where the swivelhook 24' latches into ring 104, threaded through strap of material 28 and permanently attached to the bottom of the back 14 of bag at points 203 and 204. The swivelhook attachment mechanism 24 and the slider 22 on handle 21, an extension of strap of material 28' permanently attached to the outside of the front 10 of the tote bag to position 218, extend over the top of the bag, thread inside ring 100' permanently attached to the top of the back 14 of the tote bag, and then extend freely down the back 14 of the bag to the point where swivelhook 24 latches into ring 104', threaded through strap of material 28' and permanently attached to the bottom of the back 14 of the bag at points 203' and 204'. The two handles thus positioned form two loops that allow the handles to be worn over the shoulders and the tote bag to be worn as a backpack.

The fourth embodiment can also be worn as a backpack by arranging the straps to make loops as shown in FIG. 15.

Figure 6:
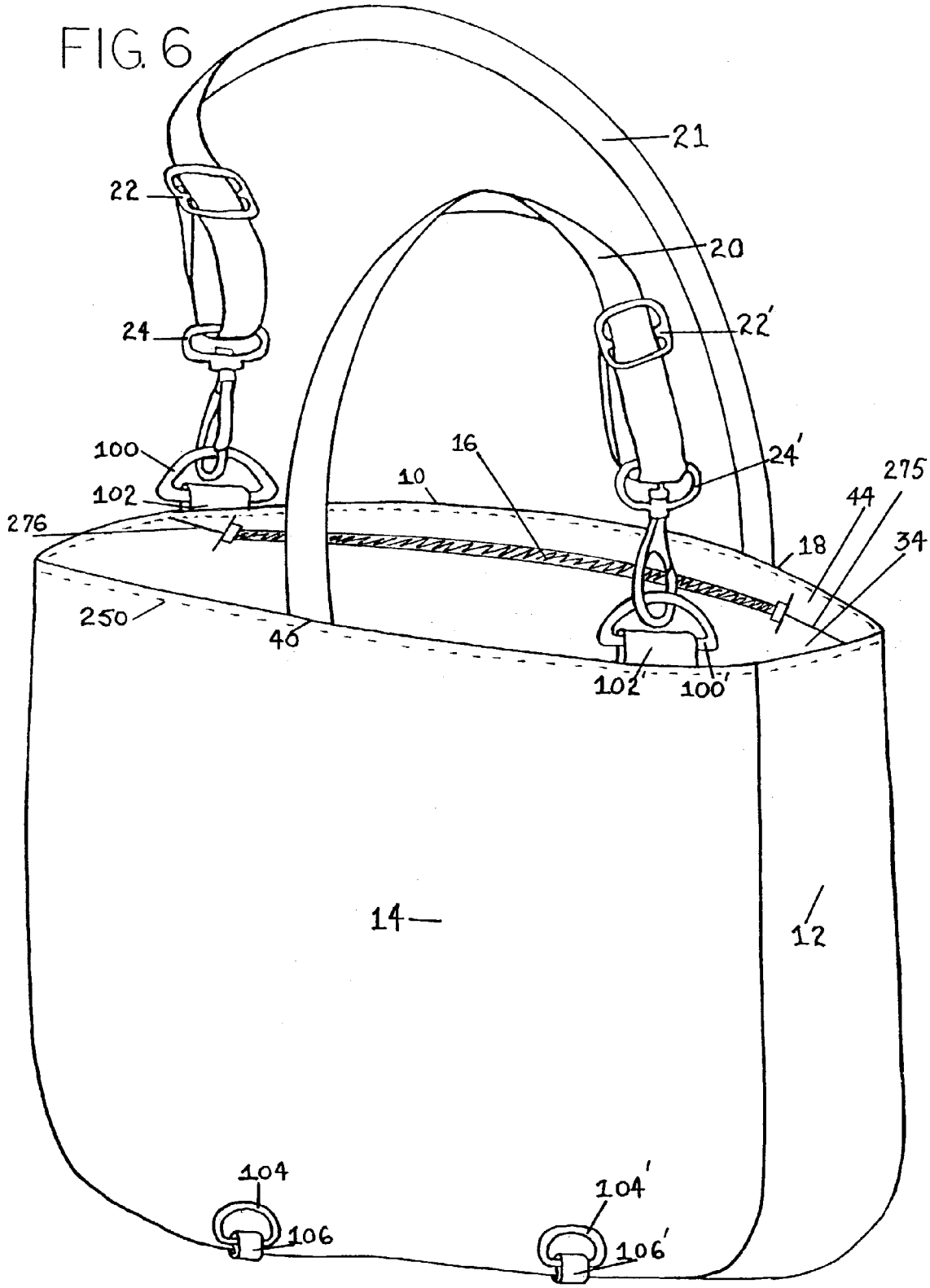
FIG. 6 is a view of the fifth embodiment of the convertible tote bag assembled as a bag.

FIG. 6 shows the fifth embodiment of the present invention. The fifth embodiment shows a closable tote bag where the zipper 16 is permanently attached to top closure sections 34 and 44, permanently attached to each other at points 275 and 276, and permanently attached to the top of the front 10, back 14, and sides 12 of the tote bag by seam 250. The front 10 of the closable tote bag has a ring 100 and strap of material 102 permanently attached to the top of the front 10 of the bag between the inside of the top of the front 10 and top closure section 44. Selectively attachable mechanism 24 is attached to ring 100. The selectively attachable mechanism shown in FIG. 6 is a swivelhook, but all kinds of snaphooks can be used in its place in all the embodiments that show the use of the swivelhook. The handle 21 is permanently attached to the top of the front 10 of the tote bag between the inside of the top of the front 10 and top closure section 44 at position 18 located towards the opposite side of the top of the front 10 of the tote bag from the ring 100 and strap of material 102. This handle 21 is placed through a slider 22 as well as the selectively attachable mechanism 24 so that the length of the handle can be adjusted. The back 14 of the tote bag has a ring 100' and strap of material 102' permanently attached to the inside top of the back 14 of the bag between the inside of the top of the back 14 and top closure section 34. Selectively attachable mechanism 24' is attached to ring 100'. The handle 20 is permanently attached to the top of the inside of the back 14 of the tote bag between the inside of the top of the back 14 and top closure section 34 at position 40 located towards the opposite side of the top of the back 14 of the tote bag from ring 100' and strap of material 102'. This handle 20 is placed through a slider 22' as well as the selectively attachable mechanism 24' so that the length of the handle can be adjusted. Ring 100 and strap of material 102 located on the front 10 of the tote bag are located opposite permanent attachment of the handle 40 on the back of the tote bag 14. Permanent attachment of the handle 18 on the front of the top of the tote bag 10 is located opposite ring 100' and strap of material 102' located on the top of the back of the tote bag 14. Ring 100 and ring 100' can be of any shape but must be large enough for the swivel-hooks 24 and 24' and the slider mechanisms 22 and 22' to thread through inside.

In addition there is a ring 104' with a strap of material 106' permanently attached to the bottom of the back 14 of the tote bag underneath the ring 100' and strap of material 102' permanently attached to the inside top of the back 14 of the bag, and another ring 104 with a strap of material 106 permanently attached to the bottom of the back 14 of the tote bag underneath permanent attachment 40 of handle 20 at the inside top of the back 14 of the tote bag. In the fifth embodiment, ring 100 and ring 100' can be of any shape but must be large enough for the swivelhooks 24 and 24' and the slider mechanisms 22 and 22' to thread through inside. Ring 104 and ring 104' can be of any shape and must only be large enough for the swivelhooks 24 and 24' to latch into. FIG. 6 shows the fifth embodiment of the present invention assembled as a tote bag.

Figure 7:
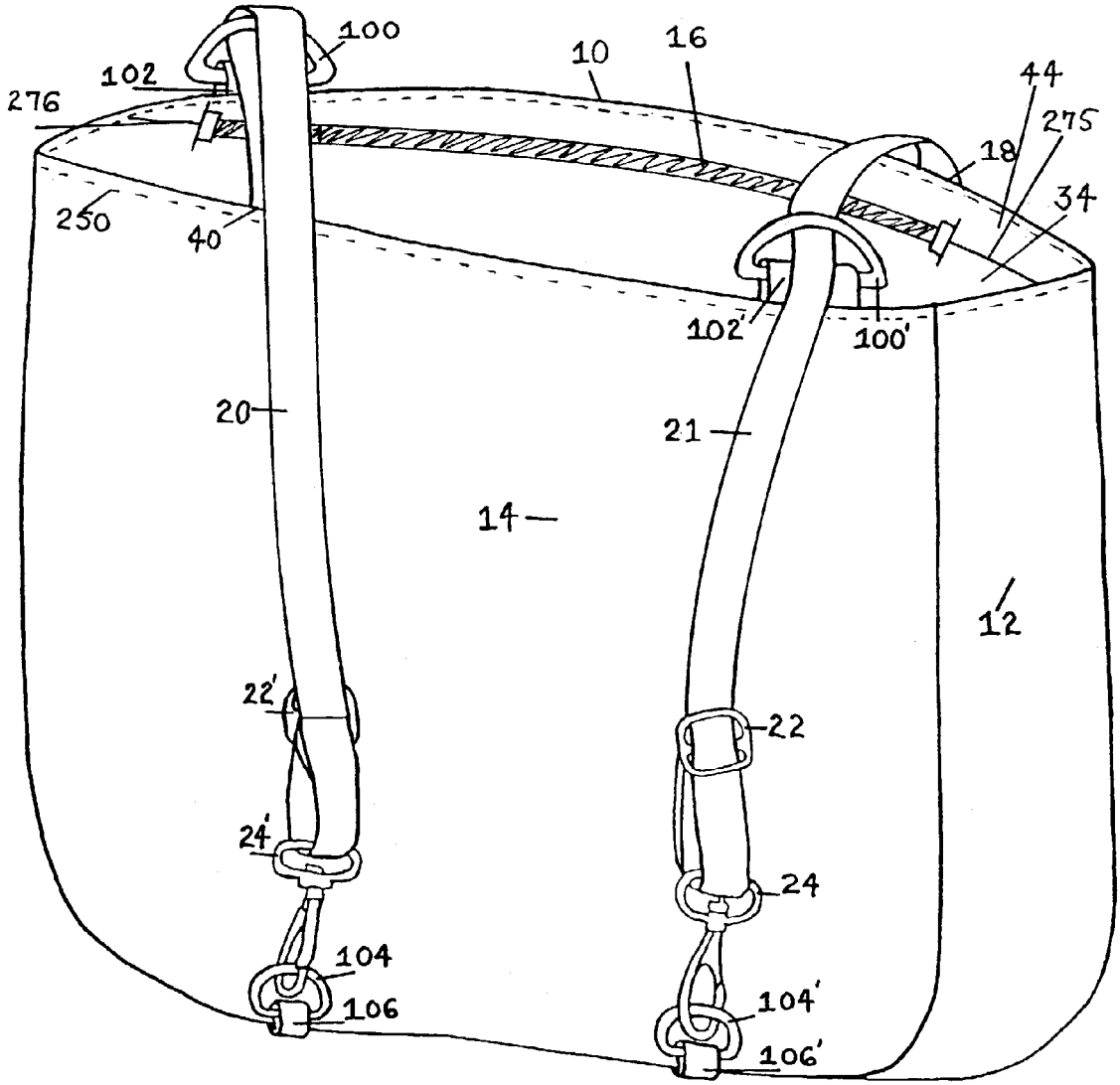
FIG. 7 is a view of the fifth embodiment of the convertible tote bag assembled as a backpack.

FIG. 7 shows the fifth embodiment of the present invention assembled as a backpack. In the fifth embodiment, the swivelhook attachment mechanism 24' and the slider 22' on handle 20, permanently attached to the top of the inside of the back of the tote bag 14 between the inside of the top of the back 14 and top closure section 34 at position 40, extend over the top of the closable bag, thread inside ring 100, and then extend back over the top of the closable tote bag down the back 14 of the bag to the point where the swivelhook 24' latches into ring 104 permanently attached to the bottom of the back 14 of the bag with strap of material 106. The swivelhook attachment mechanism 24 and the slider 22 on handle 21, permanently attached to the top of the inside of the front 10 of the tote bag between the inside of the front 10 and top closure section 44 at position 18, extend over the top of the closable bag, thread inside ring 100' permanently attached to the top of the inside of the back 14 of the closable tote bag, and then extend freely down the back 14 of the bag to the point where swivelhook 24 latches into ring 104' permanently attached to the bottom of the bag with strap of material 106. The two handles thus positioned form two loops that allow the handles to be worn over the shoulders and the tote bag to be worn as a backpack. Ring 100 and ring 100' can be of any shape but must be large enough for the swivelhooks 24 and 24' and the slider mechanisms 22 and 22' to thread through inside.

The fifth embodiment can also be worn as a backpack by arranging the straps to make loops as shown in FIG. 15.

Figure 8:
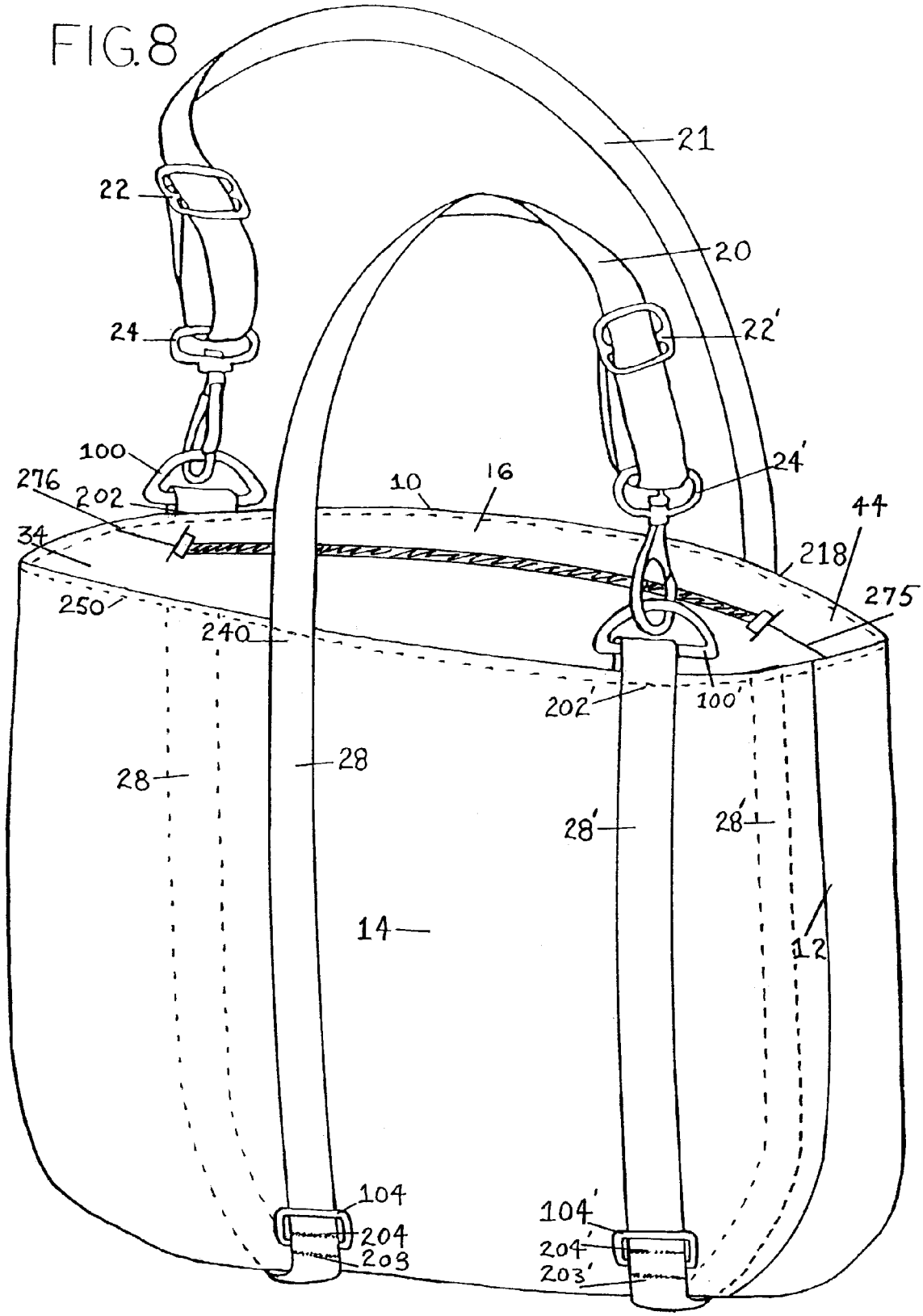
FIG. 8 is a view of the sixth embodiment of the convertible tote bag assembled as a bag.

FIG. 8 shows the sixth embodiment of the present invention assembled as a backpack. The sixth embodiment shows a closable bag. It is the same as the fifth embodiment shown in FIG. 6 with the exception that in the sixth embodiment strap of material 28 permanently attaches ring 100 to the top of the front of the bag 10 between the inside of the front 10 of the top of the bag and top closure section 44 at position 202 and is permanently attached to the outside of the front 10 of the bag from position 202 down the outside of the front 10 of the bag, across the outside of the bottom of the bag, and up the outside of the back of the bag 14 where ring 104 is threaded through it and permanently attached to the back of the bag 14 close to the bottom of the back 14 of bag with stitching through the strap of material 28 at positions 203 and 204 on the bottom and the top sides of the ring 104. Strap of material 28 is permanently attached to the outside of the back of the bag 14 up to the top where it is permanently attached at position 240, at which point it extends freely from the top of the back 14 of the bag to become handle 20. The section of the strap of material 28 from permanent attachment point 240 to position 202 is considered the further end of the strap (unnumbered). The section of the strap of material 28 from permanent attachment point 240 to swivel hook 24' is considered the free end of the strap (unnumbered). Strap of material 28' permanently attaches ring 100' to the top of the back 14 of the bag between the inside of the back 14 of the bag and top closure section 34 at position 202' and is permanently attached to the outside of the back of the bag 14 from position 202' down the outside of the back of the bag where ring 104' is threaded through it and permanently attached to the back 14 of the bag close to the bottom of the back 14 of the bag with stitching through the strap of material 28' at positions 203' and 204' on the bottom and the top sides of the ring 104'. Strap of material 28' is permanently attached across the outside of the bottom of the bag and up the outside of the front 10 of the bag where it is permanently attached to the top of the outside of the front 10 of the bag at position 218, at which point it extends freely from the top of the outside of the bag to become handle 21. The section of the strap of material 28' from permanent attachment point 218 to position 202' is considered the further end of the strap (unnumbered). The section of the strap of material 28' from permanent attachment point 218 to swivel hook 24 is considered the free end of the strap (unnumbered). These straps of material car be made of a wide variety of materials, including, but not limited to, fabric, webbing, leather, plastic or various synthetic fabrics. Ring 100 and ring 100' can be of any shape but must be large enough for the swivelhooks 24 and 24' and the slider mechanisms 22 and 22' to thread through inside. FIG. 8 shows the sixth embodiment of the present invention assembled as a tote bag.

The sixth embodiment can be assembled as a backpack in the same manner as the fifth embodiment as shown in FIG. 7, where the two handles are positioned to form two loops that selectively attach to the bottom of the back 14 of the tote bag, thus allowing the handles to be worn over the shoulders and the tote bag to be worn as a backpack.

The sixth embodiment can also be worn as a backpack by arranging the straps to make loops as shown in FIG. 15.

Figure 9:
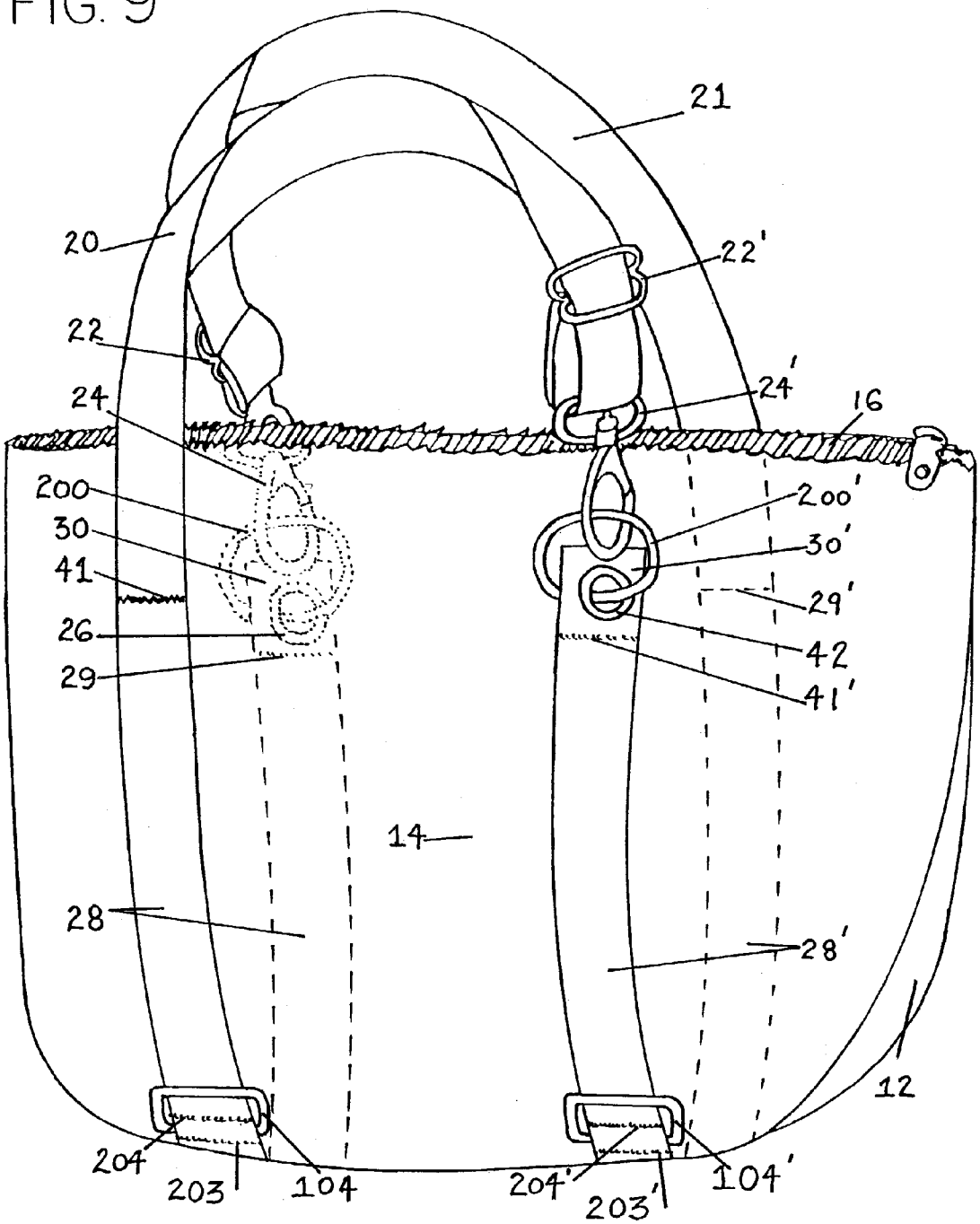
FIG. 9 is a view of the seventh embodiment of the convertible tote bag assembled as a bag.

FIG. 9 shows the seventh embodiment of the present invention assembled as a tote bag. FIG. 9 shows the seventh embodiment of the convertible tote bag as a closable bag in which the outside of the front 10 of the tote bag has a ring 200 permanently attached through a grommet 26 placed in the unattached end portion 30 of a strap of material 28. Strap of material 28 is permanently attached to the outside of the front of the bag 10 from position 29 down the outside of the front 10 of the bag, across the outside of the bottom of the bag, and up the outside of the back 14 of the bag to position 41, at which point it extends freely from the top of the outside of the back of the bag to become the handle 20. The section of the strap of material 28 from permanent attachment point 41 to the end of the strap of material 28 beyond position 29 is considered the further end of the strap (unnumbered). The section of the straps of material 28 from permanent attachment point 41 to swivel hook 24' is considered the free end of the strap (unnumbered). This strap of material can be made of a wide variety of materials, including, but not limited to, fabric, webbing, leather, plastic or various synthetic fabrics. Attached in the ring 200 on the front 10 of the tote bag is a selectively attachable mechanism 24. The handle 21 is an extension of a strap of material 28' that is permanently attached to the top of the front 10 of the tote bag at position 29' located towards the opposite side of the top of the outside of the front 10 of the tote bag from the grommet 26. Above position 29', the handle 21 extends freely front the top of the bag. This handle 21 is placed through a slider 22 so that the length of the handle can be adjusted. Below position 29', the strap of material 28' is permanently attached to the outside of the front 10 of the bag, across the outside of the bottom of the bag, and up the outside of the back 14 of the bag to position 41'. Above position 41', the strip of material extends freely from the top of the outside of the bag to form section 30', in which grommet 42 is permanently affixed. The section of the strap of material 28' from permanent attachment point 29' to the end of the strap of material 28' beyond position 41' is considered the further end of the strap (unnumbered). The section of the strap of material 28' from permanent attachment point 29' to swivel hook 24 is considered the free end of the strap (unnumbered). Ring 200' is permanently affixed through grommet 42. Selectively attachable mechanism 24' is attached to grommet 42. The handle 20 to which selectively attachable mechanism 24' is attached is permanently attached to the top of the outside of the back of the tote bag at position 41 located towards the opposite side of the top of the back 14 of the tote bag from grommet 42 with ring 200' permanently affixed through it. This handle 20 is placed through a slider 22' so that the length of the handle can be adjusted. Grommet 26 with ring 200 permanently affixed through it located on the front 10 of the tote bag is located opposite permanent attachment 41 of the handle 20 on the back 14 of the tote bag. Permanent attachment of the handle 29' on the front 10 of the top of the outside of the tote bag is located opposite the grommet 42 located on the top of the outside of the back 14 of the tote bag. The zipper 16 is permanently attached to front 10, sides 12 and back at the top of the bag. Ring 200 and ring 200' can be of any shape but must be large enough for the swivelhooks 24 and 24' and the slider mechanisms 22 and 22' to thread through inside. Other means of forming the body of the bag are, of course, possible. FIG. 9 shows the second embodiment of the present invention assembled as a tote bag.

Figure 10:
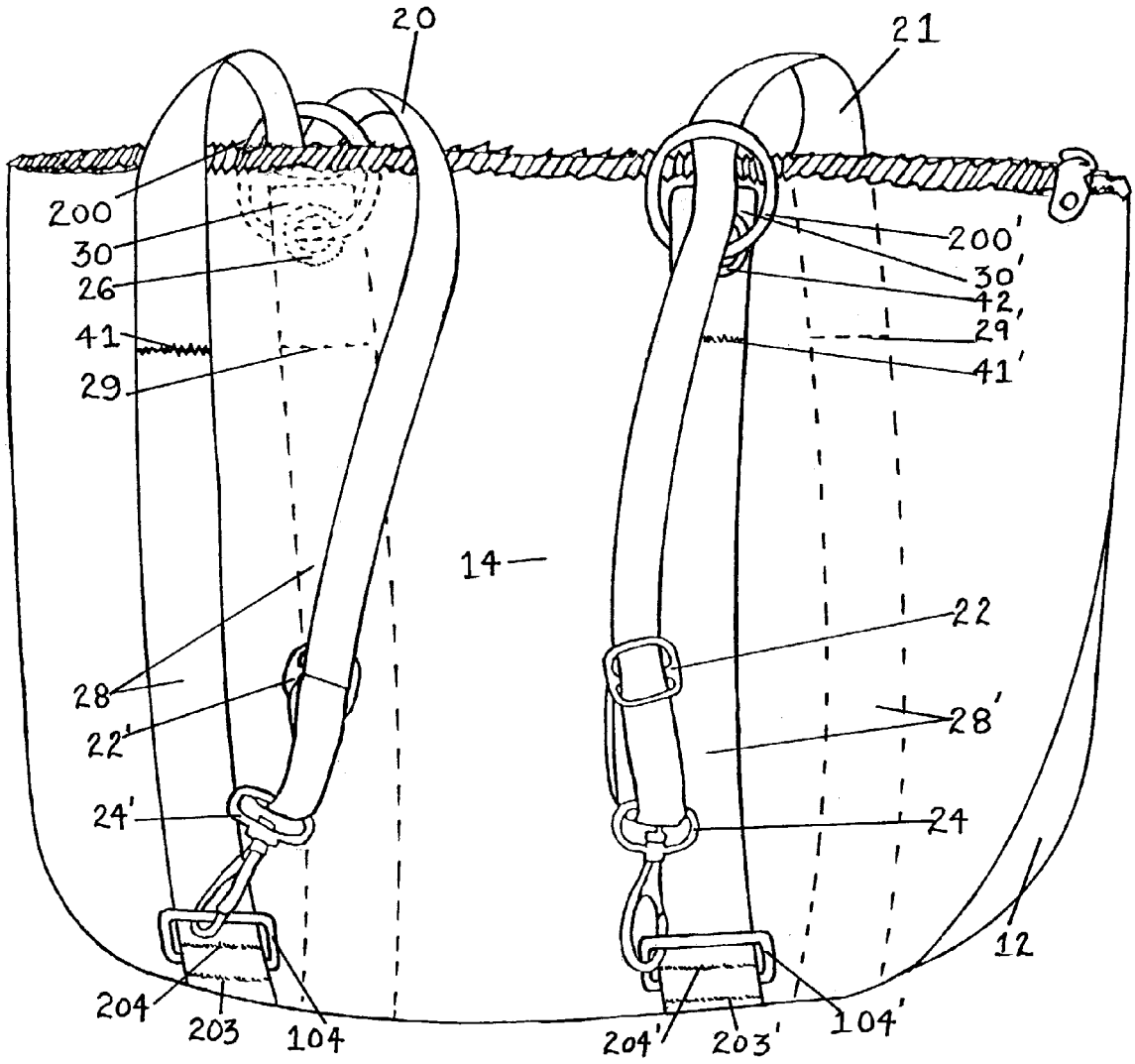
FIG. 10 is a view of the seventh embodiment of the convertible tote bag assembled as a backpack.

FIG. 10 shows the seventh embodiment of the convertible tote bag assembled as a backpack. In FIG. 10 attachment mechanism 24' of the handle 20 permanently affixed to the back of the tote bag 14 at position 41 extends over the top of the closable bag, threads inside ring 200', and then extends back over the top of the closable bag and down the back 14 of the bag to the point where the swivelhook 24' selectively attaches to ring 104 permanently attached to the bottom of the back 14 of the bag. Attachment mechanism 24 of the handle 21 permanently affixed to the front 10 of the bag to position 29' extends over the top of the closable bag, threads through ring 200', and then extends down the back 14 of the closable tote bag to the point where swivelhook 24 selectively attaches to ring 104' permanently attached to the bottom of the back 14 of the bag. This arrangement of the handles makes loops that allow the handles to be worn over the shoulders and the tote bag to be worn as a backpack.

In place of rings 200 and 200' permanently threaded through grommets 26 and 42 permanently attached to the ends 30 and 30' of straps of material 28 and 28', respectively, rings 100 and 100' can be permanently attached to the ends 30 and 30' of straps of material 28 and 28'. Rings 100 and 100' must be large enough for swivelhooks 24 and 24' and sliders 22 and 22' to thread through. The convertible tote bag can then be worn as a backpack in the same manner as described with rings 200 and 200'.

The seventh embodiment of the present invention can also be worn as a backpack by arranging the straps to make loops as shown in FIG. 15.

Figure 11:
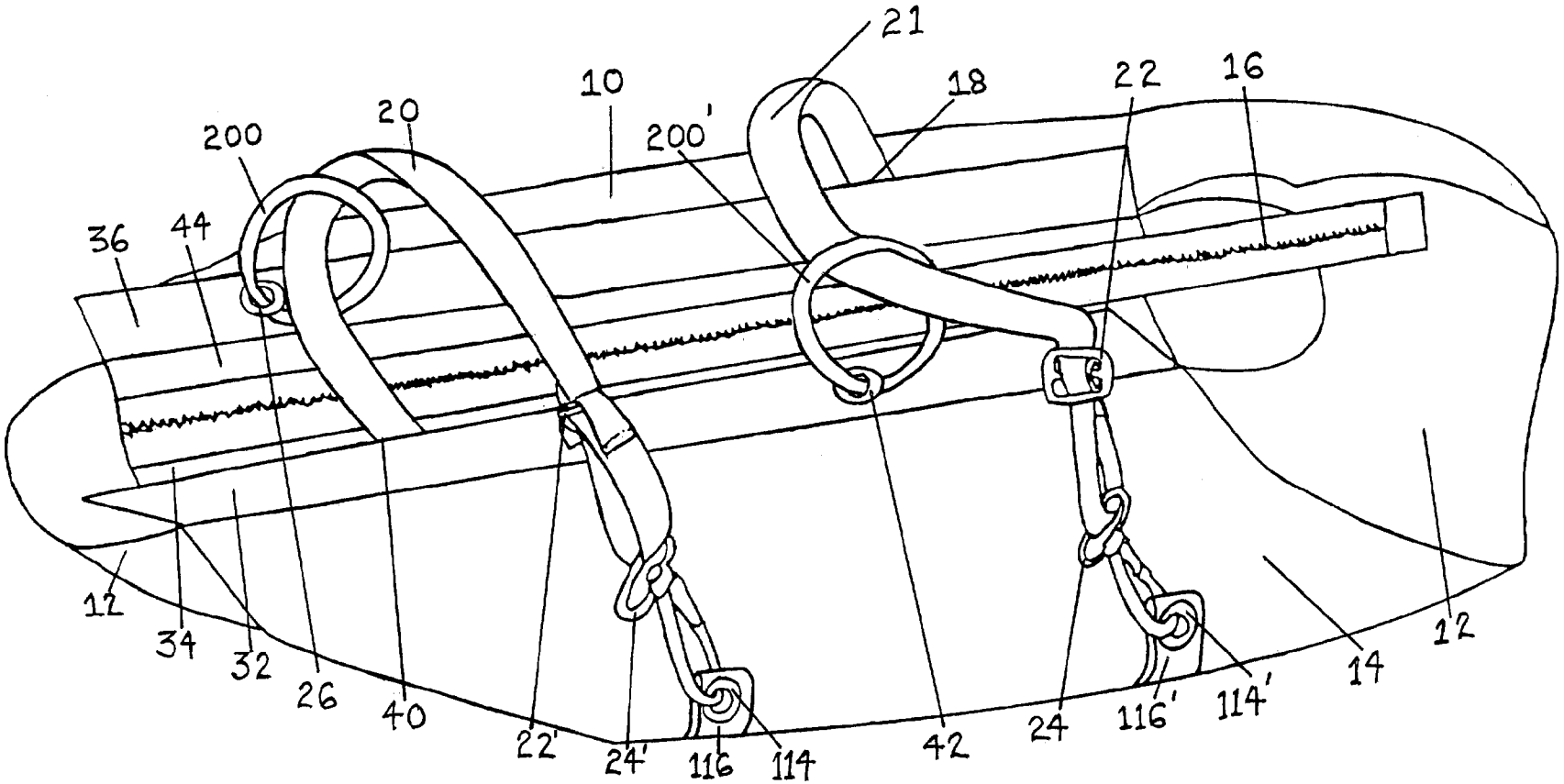
FIG. 11 is a view of the eighth embodiment of the convertible tote bag assembled as a backpack.

FIG. 11 shows the eighth embodiment of the present invention as a closable bag assembled as a backpack. The zipper 16 is permanently attached to top closure sections 34 and 44 which are respectively attached to the upward extension 32 of the back of the tote bag 14 and the upward extension 36 of the front 10 of the tote bag. In the eighth embodiment, strap of material 116' with grommet 114' permanently affixed in it is permanently affixed in the position on the back 14 of the tote bag at the bottom of the tote bag underneath the grommet 42 permanently affixed to the upward extension 32 of top of the back 14 of the bag with ring 200' permanently threaded through it, and another strap of material 116 with grommet 114 permanently affixed in it is permanently attached to the bottom of the back 14 of the tote bag underneath permanent attachment 40 of handle 20 at the inside top of the upward extension 32 of the back 14 of the bag. Ring 200 is permanently threaded through grommet 26, which is permanently affixed to the upward extension 36 of the top of the front 10 of the bag.

In the eighth embodiment, the swivelhook attachment mechanism 24' and the slider 22' on handle 20 permanently attached to upward extension 32 at the top of the inside of the back 14 of the closable tote bag at position 40 extend over the top of the bag, thread inside ring 200, then extend back over the top of the closable tote bag down the back 14 of the bag to the point where the swivelhook 24' latches into grommet 114 permanently attached to strap of material 116, which in permanently attached to the bottom of the back 14. The swivelhook attachment mechanism 24 and the slider 22 on handle 21, permanently attached to the upward extension 36 at the top of the inside of the front 10 of the tote bag at position 18, extend over the top of the closable bag, thread inside ring 200' permanently attached through the grommet 42 permanently attached to the top of the upward extension 32 of the back 14 of the tote bag, and then extend freely down the back 14 of the bag to the point where swivelhook 24 latches into grommet 114' permanently attached to strap of material 116' which is permanently attached to the bottom of the back 14 of the bag. The two handles are positioned to form two loops that selectively attach to the bottom of the back 14 of the closable tote bag, thus allowing the handles to be worn over the shoulders and the tote bag to be worn as a backpack.

Figure 18:
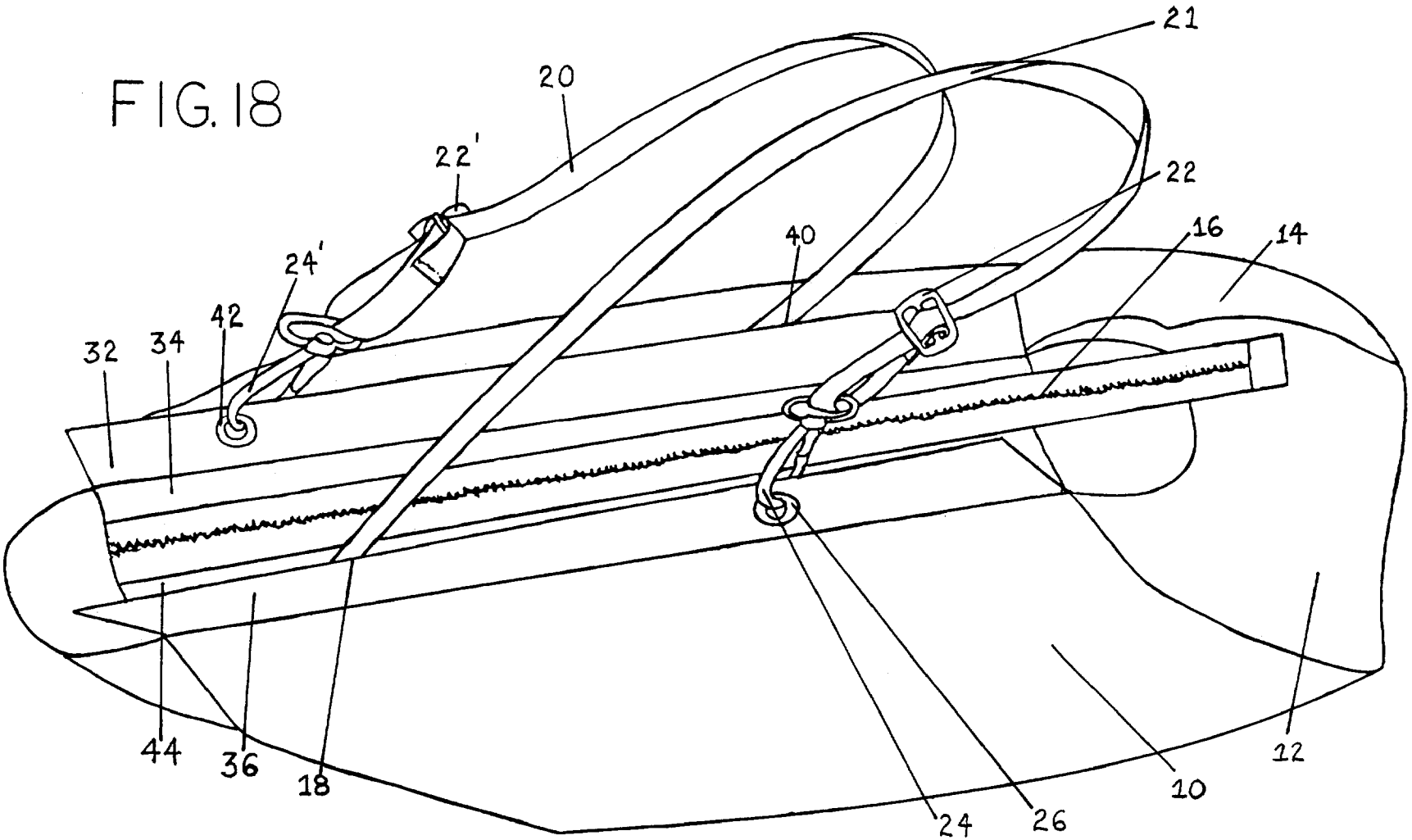
FIG. 18 is a view of the thirteenth embodiment of the convertible tote bag assembled as a bag.
Figure 19:
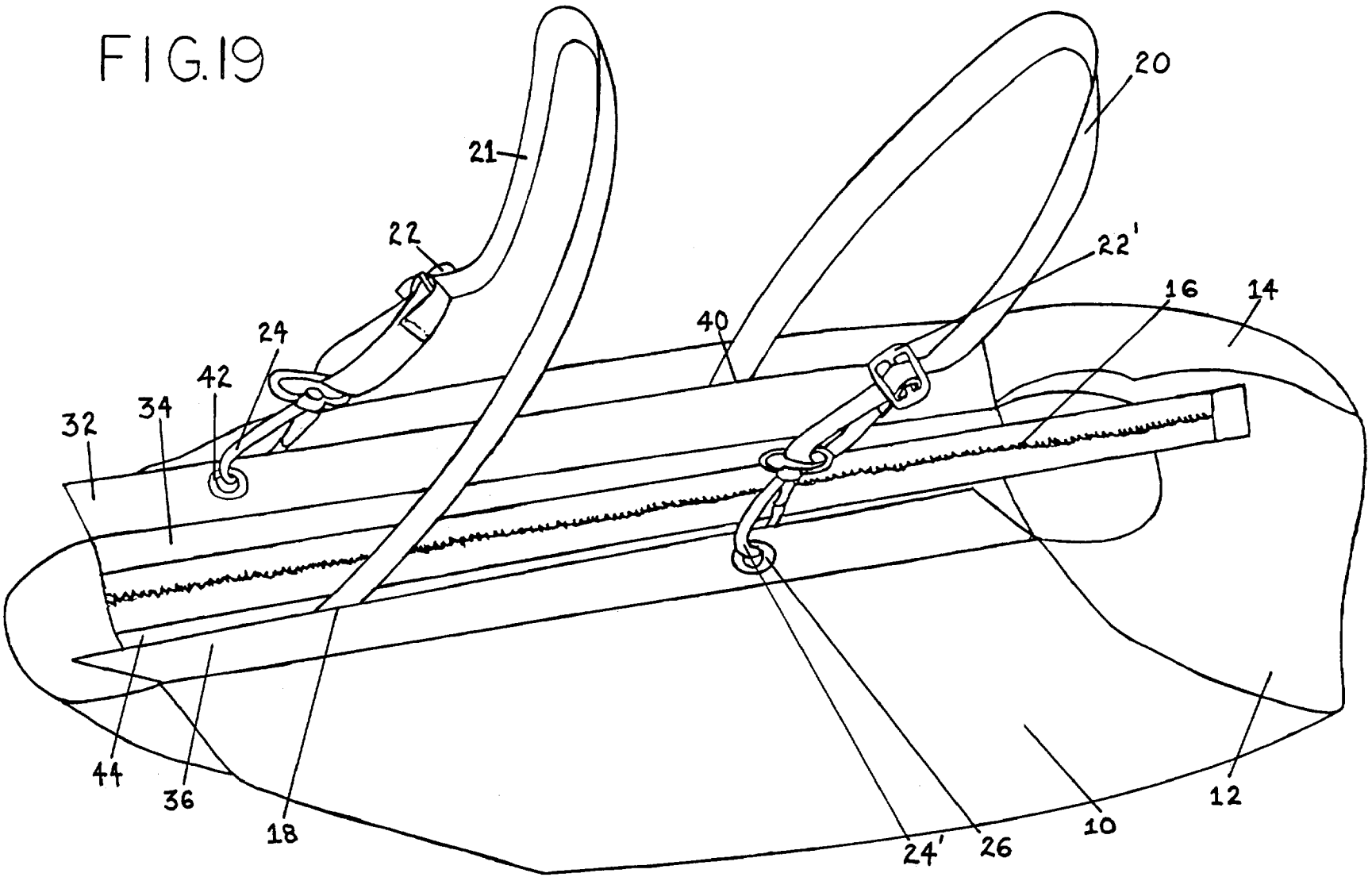
FIG. 19 is a view of the thirteenth embodiment of the convertible tote bag assembled as a backpack.

The eighth embodiment can be worn as a tote bag, either carried in the hand or on the shoulder, by arranging the straps as shown in FIG. 18 and can be assembled as a backpack by arranging the straps to make loops as show in FIG. 19.

Figure 12:
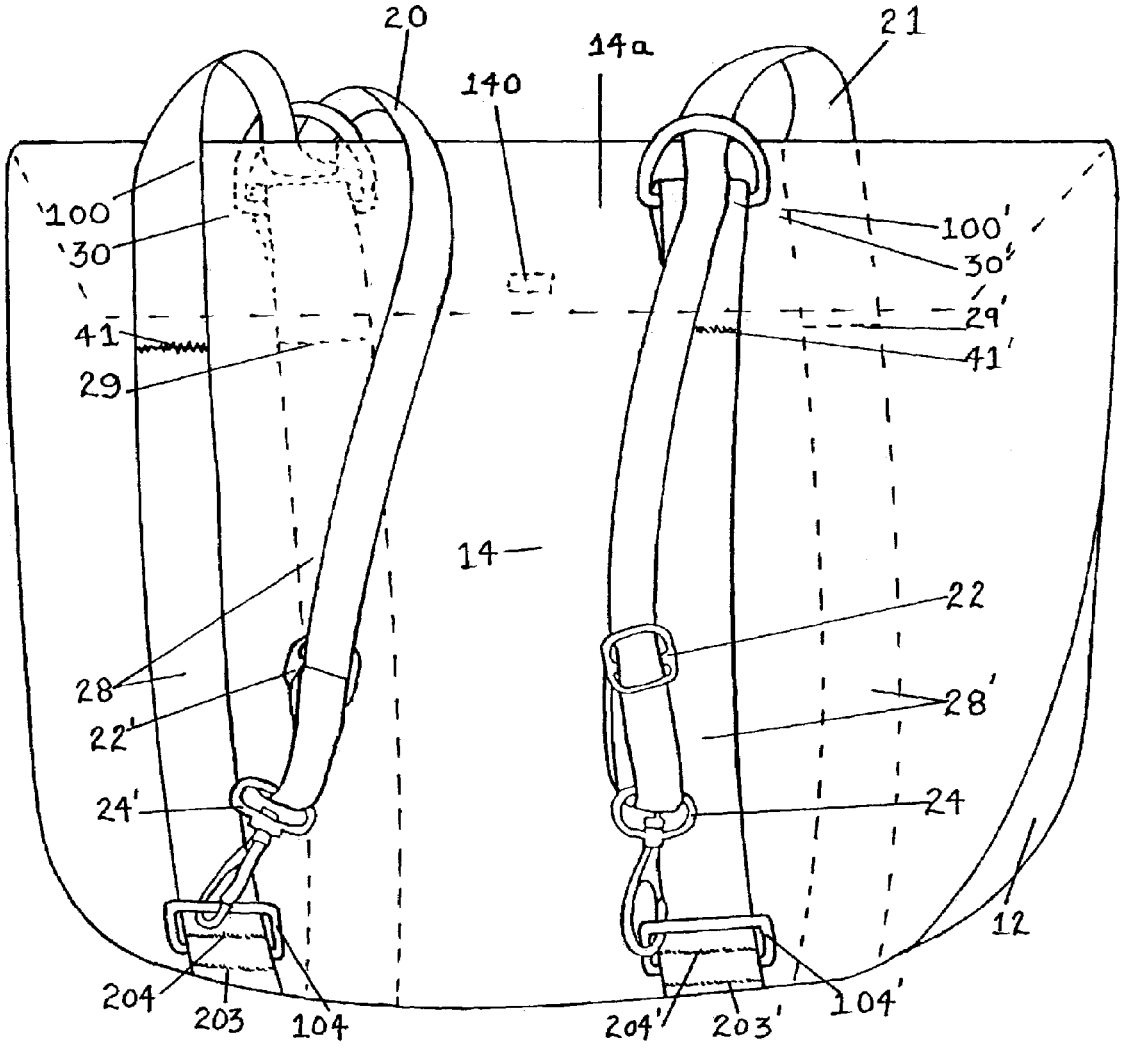
FIG. 12 is a view of the ninth embodiment of the convertible tote bag assembled as a backpack.

FIG. 12 shows the ninth embodiment of the convertible tote bag with a flap closure **14*a* that is an extension of the back 14 of the bag that extends over the top of the bag and over the front 10 behind the end 30 of strap of material 28 to the position 29 where strap of material 28 is no longer permanently attached to the front of the bag 10, and behind handle 21 that is an extension of strap of material 28' that is permanently attached to the front 10 of the bag to position 29'. Flap closure 14*a* is secured by a latch bag closure 140. The flap closure 14*a* can be selectively secured with the full range of closures know in the art of making bags, including, but not limited to, latches, hook and loop tape, button loops and buttons, and side release buckles. In FIG. 12, attachment mechanism 24' of the handle 20 permanently affixed to the back of the tote bag 14 at position 41 extends over the top of the closable bag, threads inside ring 100, and then extends back over the top of the closable bag and down the back 14 of the closable tote bag to the point where the swivelhook 24' selectively attaches to ring 104 permanently attached to the bottom of the back 14 of the bag. The section of the strap of material 28 from permanent attachment point 41 to the end of the strap of material 28 beyond position 29 is considered the further end of the strap numbered). The section of the strap of material 28 from permanent attachment point 41 to swivel hook 24' is considered the free end of the strap (unnumbered). Attachment mechanism 24 of the handle 21 that is an extension of strap of fabric 28' permanently affixed to the front 10 of the bag to position 29', extends over the top of the closable bag, threads through ring 100', and then extends down the back 14 of the closable tote bag to the point where swivelhook 24 selectively attaches to ring 104' permanently attached to the bottom of the back 14 of the bag. The section of the strap of material 28' from permanent attachment point 29' to the end of the strap of material 28' beyond position 41' is considered the further end of the strap (unnumbered). The section of the strap of material 28' from permanent attachment point 29' to swivel hook 24** is considered the free end of the strap (unnumbered). This arrangement of the handles makes loops that allow the handles to be worn over the shoulders and the tote bag to be worn as a backpack.

Rings 100 and 100' are permanently attached to the ends 30 and 30' of straps of material 28 and 28', respectively. Rings 100 and 100' must be large enough for swivelhooks 24 and 24' and sliders 22 and 22' to thread through.

Figure 23:
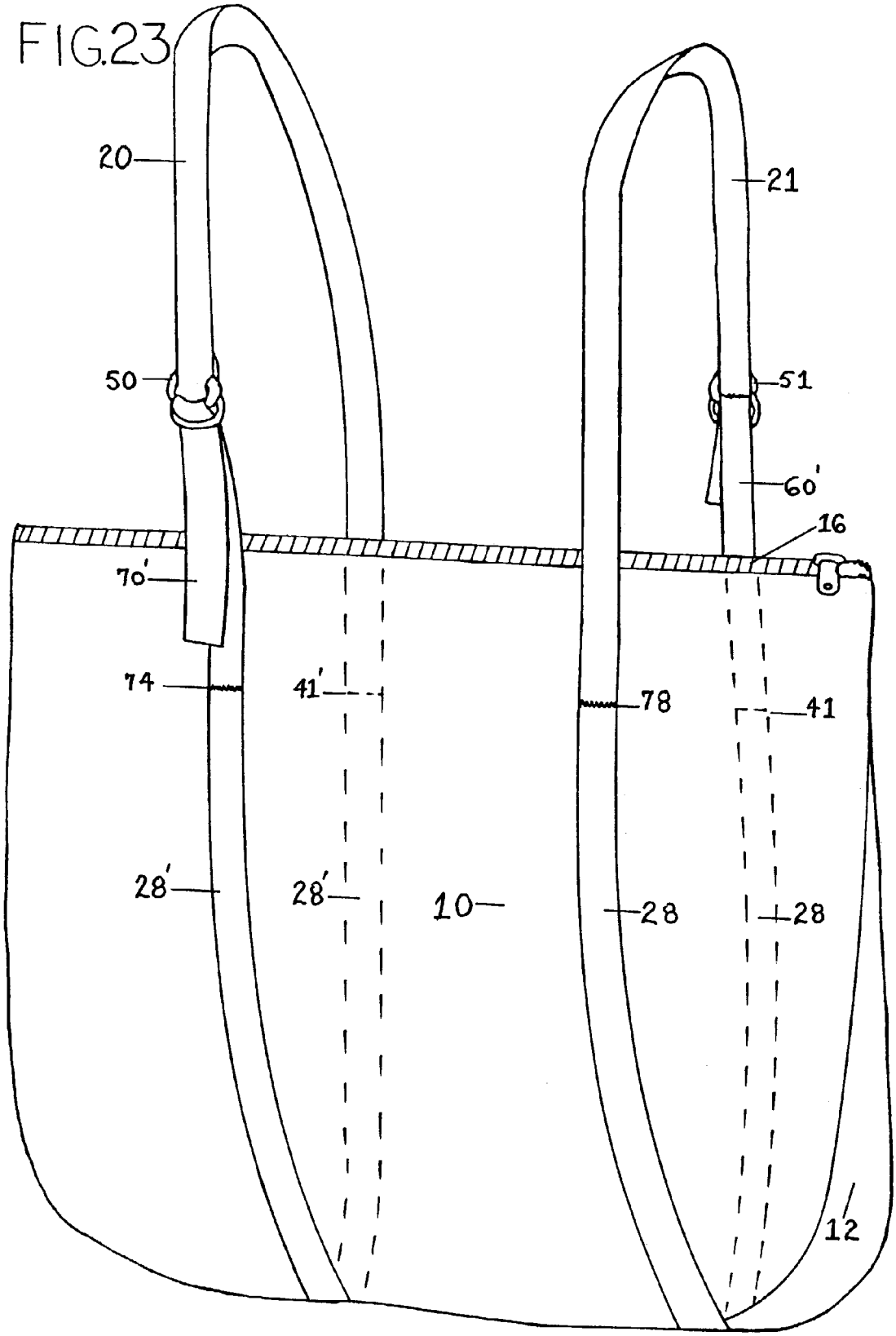
FIG. 23 is a view of the fifteenth embodiment of the convertible tote bag assembled as a backpack.
Figure 24:
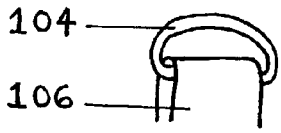
FIG. 24 is a view of a small sized single D-ring with attachment strap.
Figure 25:
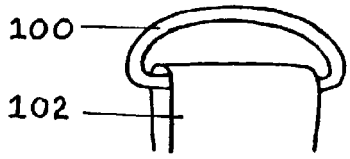
FIG. 25 is a view of a large sized single D-ring with attachment strap.
Figure 26:
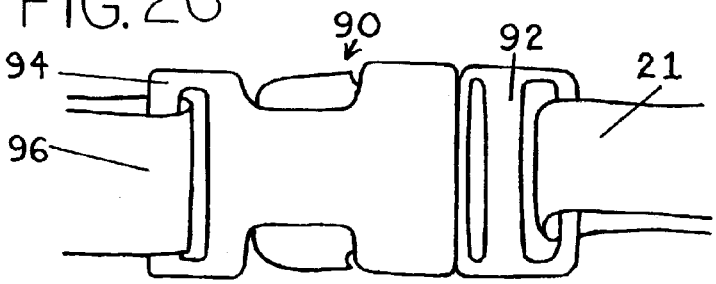
FIG. 26 is a view of a closed side release buckle with attachment straps.
Figure 27:
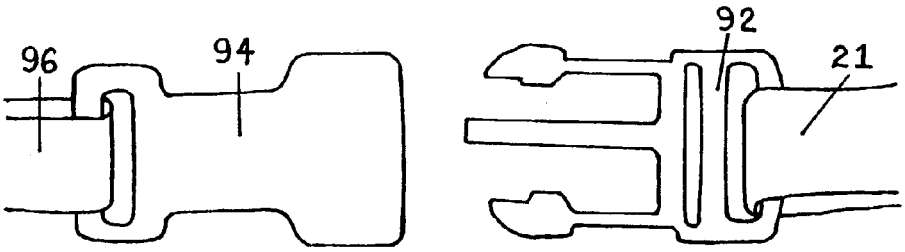
FIG. 27 is a view of an opened side release buckle with attachment straps.
Figure 28:
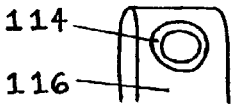
FIG. 28 is a view of grommet in an attachment strap.
Figure 40:
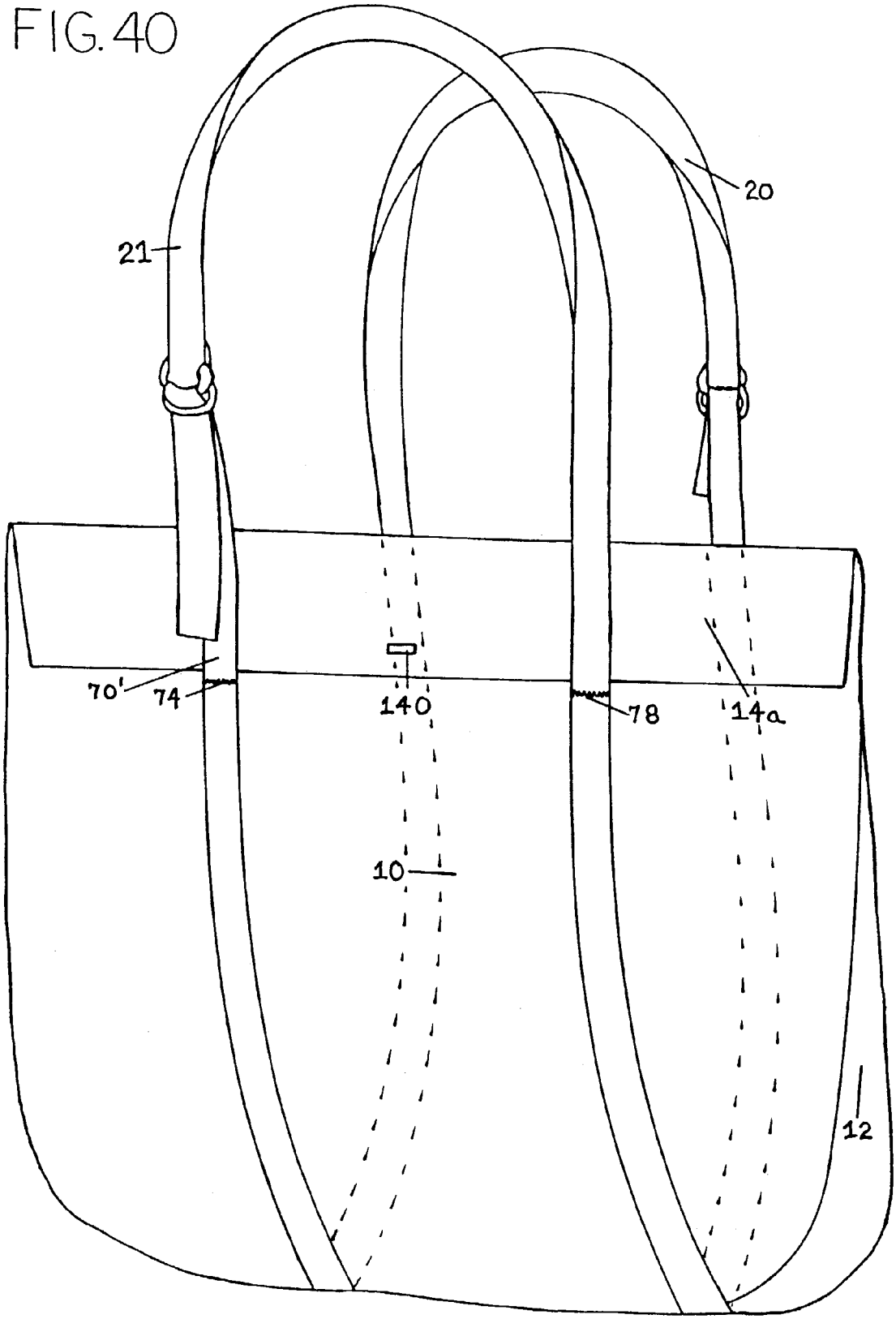
FIG. 40 is a view of the fifteenth embodiment of the convertible tote bag with a flap closure at the top of the tote bag.

The ninth embodiment can be worn as a tote bag, either carried in the hand or on the shoulder, by arranging the straps as shown in FIG. 40 and can be assembled as a backpack by arranging the straps to make loops as show in FIG. 23.

This type of top closure can be used with all the embodiments of the present invention in which straps of material are permanently attached part of the way up the front and back of the tote bag, then extending freely from the bag. It could replace the zipper in those embodiments that use zippers.

Figure 13:
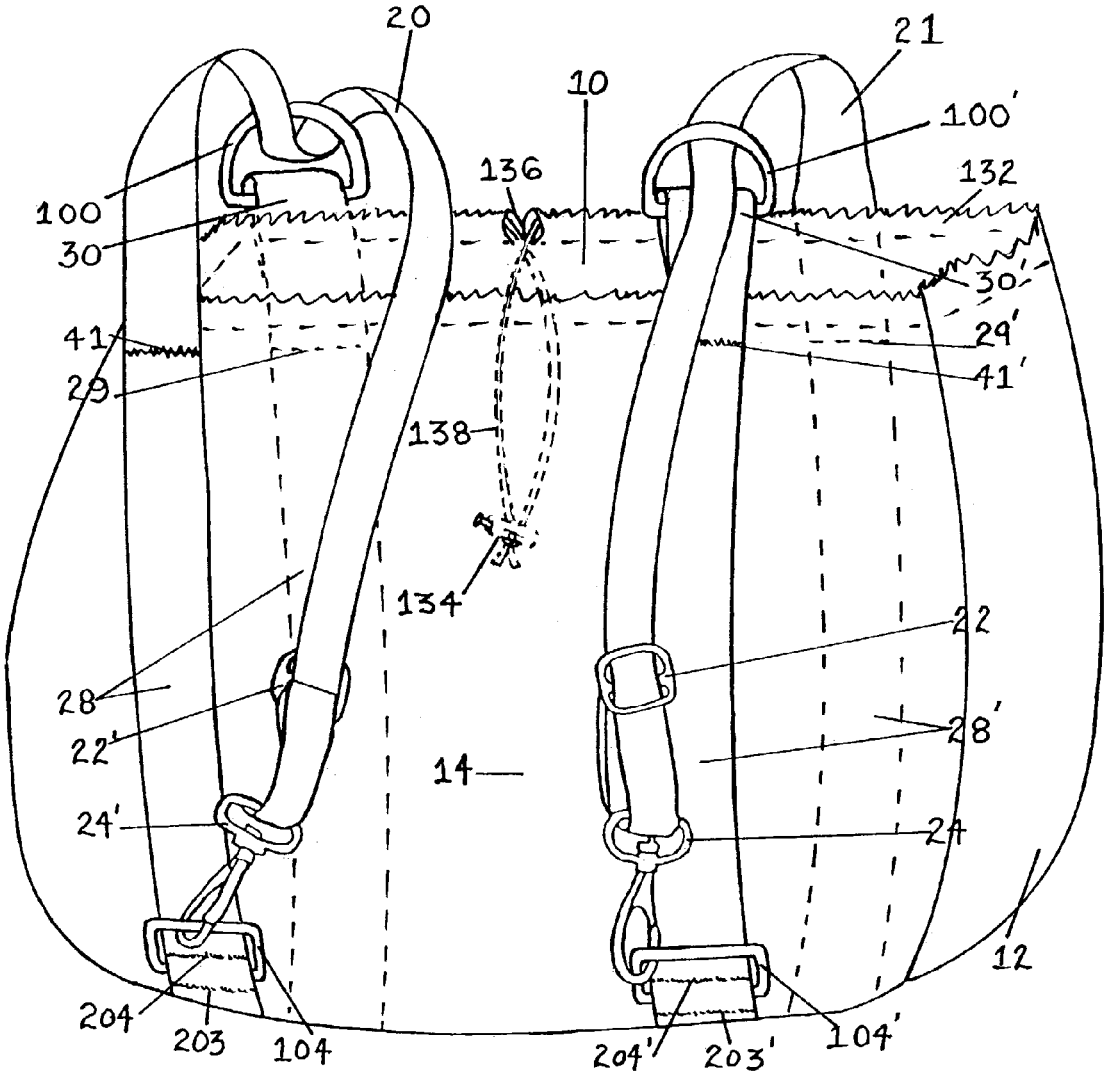
FIG. 13 is a view of the tenth embodiment of the convertible tote bag assembled as a backpack.

FIG. 13 shows the tenth embodiment of the convertible tote bag with a drawstring closure 132. The drawstring 138 extends through the opening 136 in the drawstring closure 132 at the top of the front 10 of tote bag. The length of the drawstring can be adjusted by the use of cord closure 134. In FIG. 13, attachment mechanism 24' of the handle 20 permanently affixed to the back of the tote bag 14 to position 41 extends over the top of the closable bag, threads inside ring 100, and then extends back over the top of the closable bag and down the back 14 of the closable tote bag to the point where the swivelhook 24' selectively attaches to ring 104 permanently attached to the bottom of the back 14 of the bag. The section of the strap of material 28 from permanent attachment point 41 to the end of the strap of material 28 beyond position 29 is considered the further end of the strap (unnumbered). The section of the strap of material 28 from permanent attachment point 41 to swivel hook 24' is considered the free end of the strap (unnumbered). Attachment mechanism 24 of the handle 21 that is an extension of strap of fabric 28' permanently affixed to the front 10 of the bag to position 29', extends over the top of the closable bag, threads through ring 100', and then extends down the back 14 of the closable tote bag to the point where swivelhook 24 selectively attaches to ring 104' permanently attached to the bottom of the back 14 of the bag. The section of the strap of material 28' from permanent attachment point 29' to the end of the straw of material 28' beyond position 41' is considered the further end of the strap (unnumbered). The section of the strap of material 28' from permanent attachment pint 29' to swivel hook 24 is considered the free end of the strap (unnumbered). This arrangement of the handles makes loops that allow the handles to be worn over the shoulders and the tote bag to be worn as a backpack.

Rings 100 and 100' are permanently attached to the ends 30 and 30' of straps of material 28 and 28', respectively. Rings 100 and 100' must be large enough for swivelhooks 24 and 24' and sliders 22 and 22' to thread through.

Figure 41:
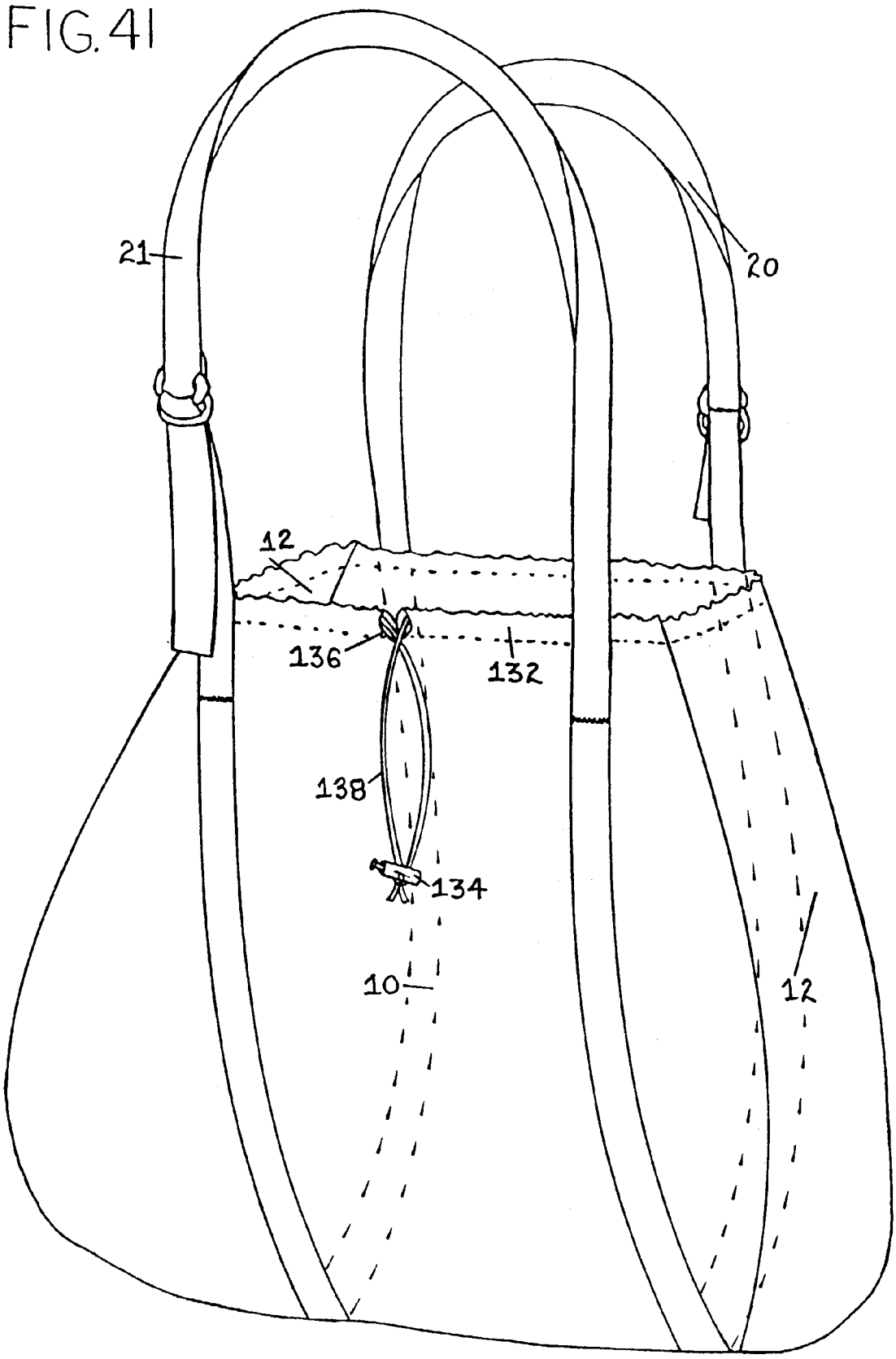
FIG. 41 is a view of the fifteenth embodiment of the convertible tote bag with a drawstring closure at the top of the tote bag.

The tenth embodiment can be worn as a tote bag, either carried in the hand or on the shoulder, by arranging the straps as shown in FIG. 41 and can be assembled as a backpack by arranging the straps to make loops as show in FIG. 23.

This type of top closure can be used with all the embodiments of the present invention in which straps of material are permanently attached part of the way up the front and back of the tote bag, then extending freely from the bag. It could replace the zipper in those embodiments that use zippers.

Figure 14:
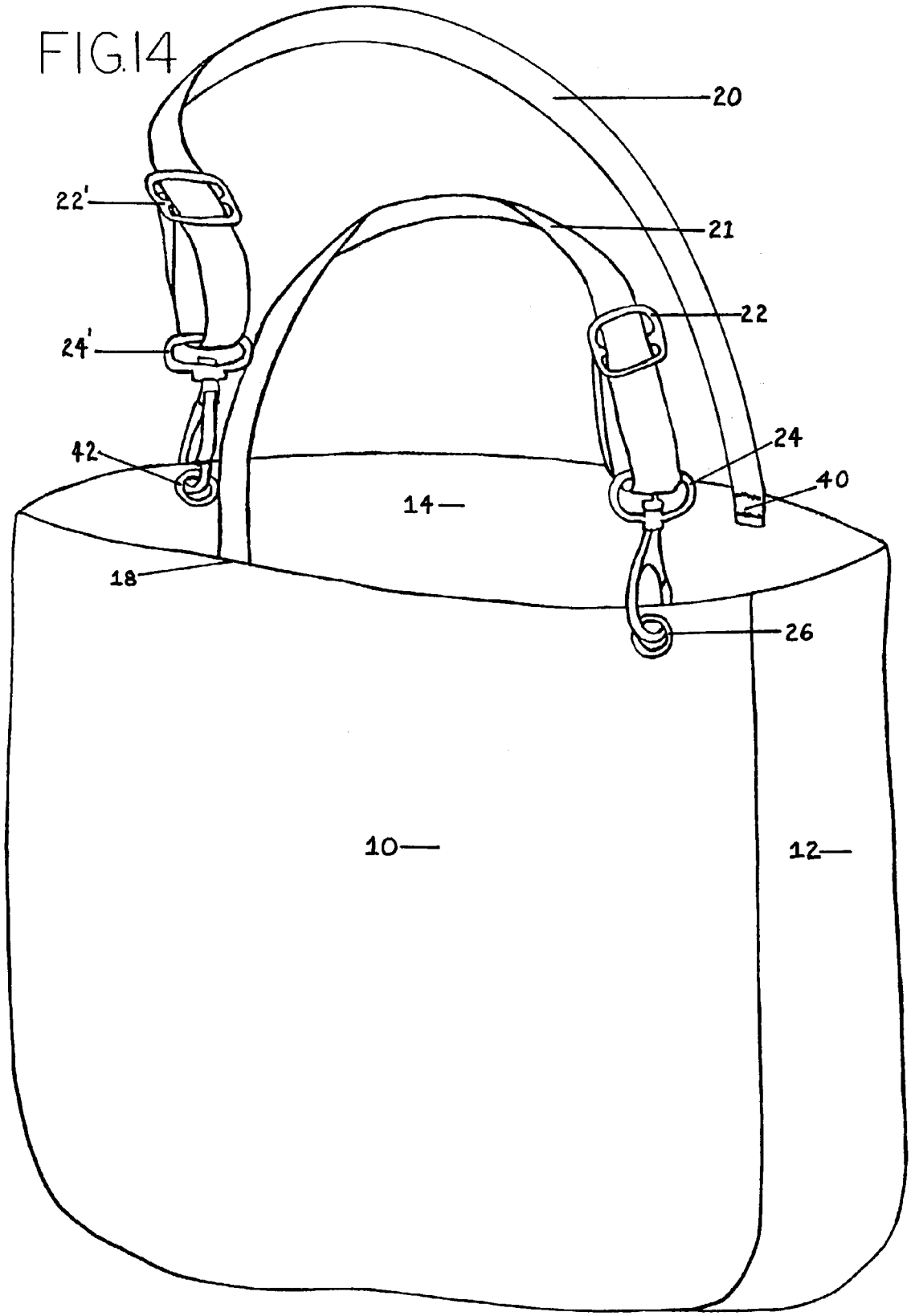
FIG. 14 is a view of the eleventh embodiment of the convertible tote bag assembled as a bag.

FIG. 14 shows the eleventh embodiment of the present invention. In the eleventh embodiment, the front of the tote bag 10 has a grommet 26 in which a selectively attachable mechanism 24 is attached. The selectively attachable mechanism shown in FIG. 14 is a swivelhook, but all kinds of snaphooks can be used in its place in all the embodiments that show the use of the swivelhook. The handle 21 is permanently attached to the top of the inside of the front of the tote bag 10 at position 18 located towards the opposite side of the top of the front of the tote bag 10 from the grommet 26. This handle 21 is placed through a slider 22 as well as the selectively attachable mechanism 24 so that the length of the handle can be adjusted. The back of the tote bag 14 has a grommet 42 in which a selectively attachable mechanism 24 is attached. The handle 20 is permanently attached to the top of the inside of the back of the tote bag 14 at position 40 located towards the opposite side of the top of the back of the tote bag 14 from the grommet 42. This handle 20 is placed through a slider 22' as well as the selectively attachable mechanism 24' so that the length of the handle can be adjusted. Grommet 26 located on the front 10 of the tote bag is located opposite permanent attachment of the handle 40 on the back of the tote bag 14. Permanent attachment of the handle 18 on the front of the top of the tote bag 10 is located opposite the grommet 40 located on the top of the back of the tote bag 14. FIG. 14 shows the first embodiment of the present invention assembled as a tote bag.

FIG. 15 shows the eleventh embodiment of the convertible tote bag in which the attachment mechanism 24 of the handle 21 permanently affixed to the front of the tote bag 10 at position 18 selectively attached to the grommet 42 at the top of the back 14 of the tote bag, and it shows the attachment mechanism 24' of the handle 20 permanently affixed to the back of the tote bag 14 at position 40 selectively attached to the grommet 26 at the top of the front 10 of the tote bag. This arrangement of the handles makes loops that allow the handles to be worn over the shoulders and the tote bag to be worn as a backpack.

Figure 16:
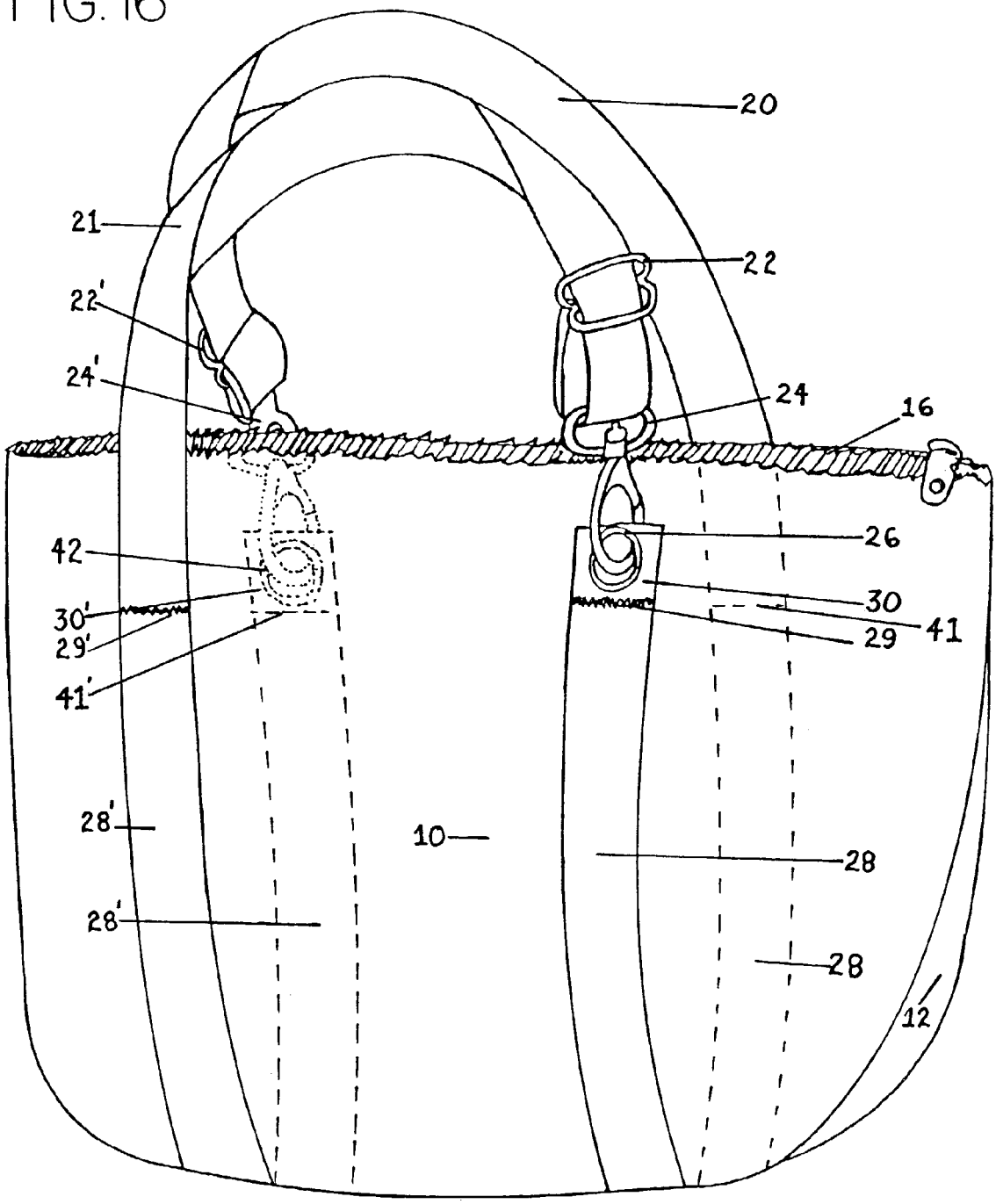
FIG. 16 is a view of the twelfth embodiment of the convertible tote back assembled as a bag.

FIG. 16 shows the twelfth embodiment of the convertible tote bag as a closable bag in which the outside of the front of the tote bag 10 has a grommet 26 in the unattached end portion 30 of a strap of material 28. Strap of material 28 is permanently attached to the outside of the front of the bag 10 from position 29 down the outside of the front of the bag, across the outside of the bottom of the bag, and up the outside of the back of the bag to position 41, at which point it extends freely from the top of the outside of the bag to become the handle 20. The section of the strap of material 28 from permanent attachment point 41 to the end of the strap of material 28 beyond position 29 is considered the further end of the strap (unnumbered). The section of the strap of material 28 from permanent attachment point 41 to swivel hook 24' is considered the free end of the strap unnumbered). This strap of material can be made of a wide variety of materials, including, but not limited to, fabric, webbing, leather, plastic or various synthetic fabrics. Attached in the grommet 26 on the front of the tote bag 10 is a selectively attachable mechanism 24. The handle 21 is an extension of a strap of material 28' that is permanently attached to the top of the front of the tote bag 10 at position 29' located towards the opposite side of the top of the outside of the front of the tote bag 10 from the grommet 26. Above position 29', the handle 21 extends freely from the top of the bag. This handle 21 is placed through a slider 22 so that the length of the handle can be adjusted. Below position 29', the strap of material 28' is permanently attached to the outside of the front of the bag 10, across the outside of the bottom of the bag, and up the outside of the back of the bag to position 41'. Above position 41', the strip of material extends freely from the top of the outside of the bag to form section 30', in which grommet 42 is permanently affixed. Selectively attachable mechanism 24' is attached to grommet 42. The section of the strap of material 28' from permanent attachment point 29' to the end of the strap of material 28' beyond position 41' is considered the further end of the strap (unnumbered). The section of the strap of material 28' from permanent attachment point 29' to swivel hook 24 is considered the free end of the strap (unnumbered). The handle 20 to which selectively attachable mechanism 24' is attached is permanently attached to the top of the outside of the back of the tote bag at position 41 located towards the opposite side of the top of the back of the tote bag from the grommet 42. This handle 20 is placed through a slider 22' so that the length of the handle can be adjusted. Grommet 26 located on the front 10 of the tote bag is located opposite permanent attachment 41 of the handle 20 on the back of the tote bag. Permanent attachment of the handle 29' on the front of the top of the outside of the tote bag 10 is located opposite the grommet 42 located on the top of the outside of the back of the tote bag. The zipper 16 is permanently attached to front 10, sides 12 and back at the top of the bag. Other means of forming the body of the bag are, of course, possible. FIG. 16 shows the twelfth embodiment of the present invention assembled as a tote bag.

Figure 17:
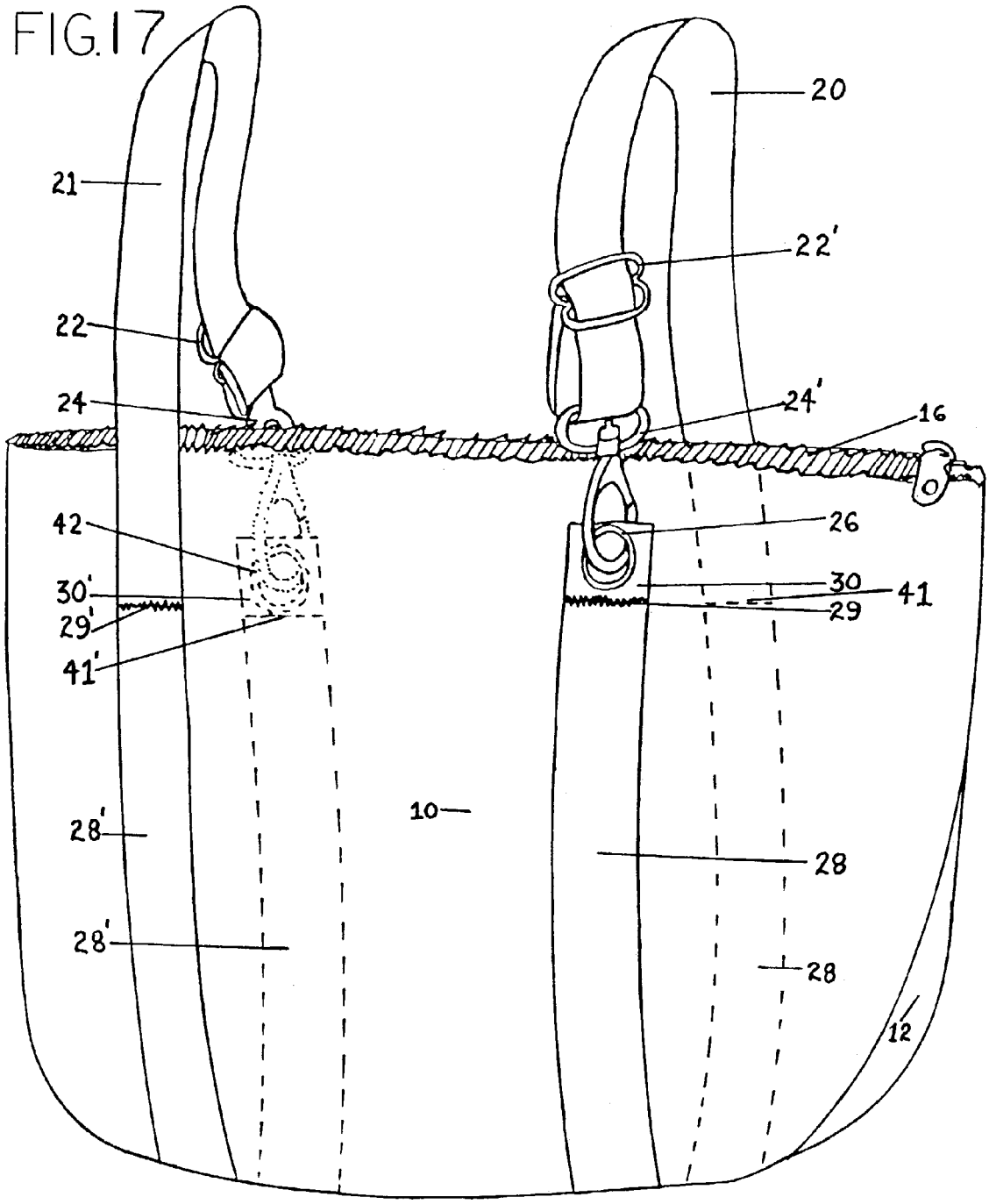
FIG. 17 is a view of the twelfth embodiment of the convertible tote bag assembled as a backpack.

FIG. 17 shows the twelfth embodiment of the convertible tote bag in which the attachment mechanism 24 of the handle 21 permanently affixed to the front of the tote bag 10 at position 29' is selectively attached to the grommet 42 at the top of the back of the tote bag, and it shows the attachment mechanism 24' of the handle 20 permanently affixed to the back of the tote bag at position 41 selectively attached to the grommet 26 at the top of the front 10 of the tote bag. This arrangement of the handles makes loops that allow the handles to be worn over the shoulders and the tote bag to be worn as a backpack.

FIG. 18 shows the thirteenth embodiment of the convertible tote bag as a closable bag in which there is a grommet 26 in the upward extension 36 of the front of the tote bag 10. Attached in the grommet 26 is a selectively attachable mechanism 24 which is attached to the handle 21. Handle 21 is permanently attached to the end portion 36 of the front of the tote bag 10 at position 18 located towards the opposite side of the top of the front of the tote bag 10 from the grommet 26. This handle 21 is placed through a slider 22 so that the length of the handle can be adjusted. The back of the tote bag 14 has a grommet 42 in the upward extension 32 of the back of the bag 14 in which a selectively attachable mechanism 24' is attached. Selectively attachable mechanism 24' is attached to the handle 20, which is permanently attached to the end portion 32 of the back of the tote bag 14 at position 40 located towards the opposite side of the top of the back of the tote bag 14 from the grommet 42. This handle 20 is placed through a slider 22' so that the length of the handle can be adjusted. Grommet 26 located on the upward extension 36 of the front of the tote bag 10 is located opposite permanent attachment of the handle 40 on the upward extension 32 of the back of the tote bag 14. Permanent attachment of the handle 18 on the end portion 36 of the front of the top of the tote bag 10 is located opposite the grommet 42 located on the end portion 32 of the back of the tote bag 14. The zipper 16 is permanently attached to sections 34 and 44 which are respectively attached to the upward extension 32 of the back of the tote bag 14 and the upward extension 36 of the front 10 of the tote bag. FIG. 5 shows the third embodiment of the present invention assembled as a tote bag.

FIG. 19 shows the attachment mechanism 24 of the handle 21 permanently affixed to the upward extension 36 of the front of the tote bag 10 at position 18 selectively attached to the grommet 42 at the upward extension 32 of the top of the back 14 of the tote bag, and it shows the attachment mechanism 24' of the handle 20 permanently affixed to the upward extension 32 of the back of the tote bag 14 at position 40 selectively attached to the grommet 26 at the upward extension 36 of the front of the tote bag 10. FIG. 19 shows the thirteenth embodiment of the present invention with an arrangement of the handles that make loops that allow the handles to be worn over the shoulders and the tote bag to be worn as a backpack.

Figure 20:
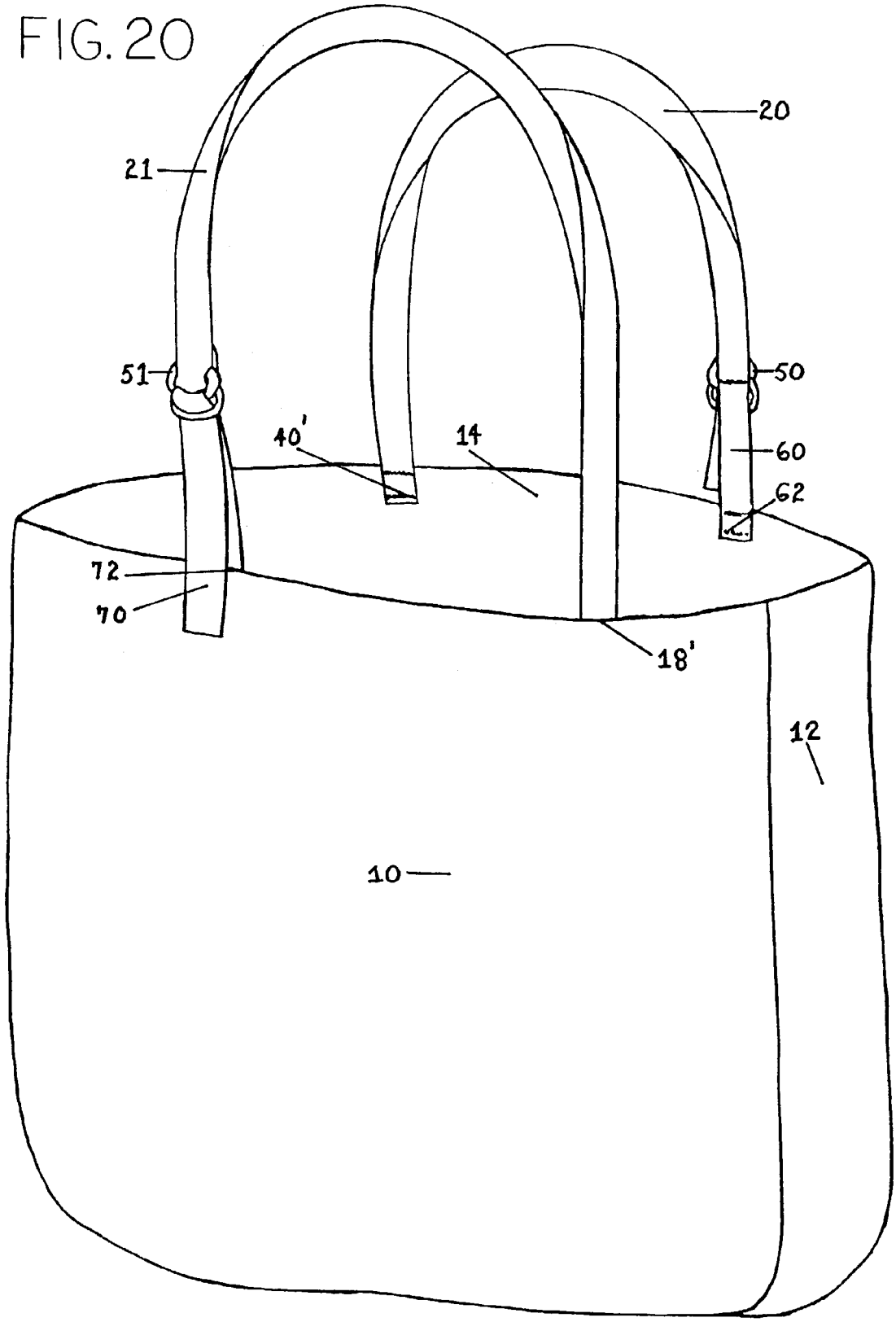
FIG. 20 is a view of the fourteenth embodiment of the convertible tote bag assembled as a bag.

FIG. 20 shows the fourteenth embodiment of the convertible tote bag in which the front of the tote bag 10 has a strap 70 permanently attached to the top of the front of the tote bag 10 at position 72. This strap is used to selectively attach the D-rings 51 permanently affixed to the handle 21 that is permanently attached to the top of the front of the tote bag 10 at location 18'. The back of the tote bag 14 has a strap 60 permanently attached to the top of the back of the tote bag 14 at position 62. This strap is used to selectively attach the D-rings 50 permanently affixed to the handle 20 that is permanently attached to the top of the back of the tote bag 14 at position 40'. Straps 60 and 70 allow for the length of the handles to be adjustable. In place of D-rings 50 and 51 in all of the embodiments that display them, a full range of ladderlocs and cams can be used as the attachment mechanism. FIG. 17 shows the detail of the ladderloc. FIG. 18 shows the detail of the cam. FIG. 19 shows the detail of an alternate placement of the cam in which handle 20 has a free end instead of D-rings 50 and strap 60 is replaced with strap of material 84 attached to the cam 82. Strap of material 84 is permanently attached to the top of the bag at 62. This same arrangement is used to replace the second D-ring 51 and strap of material 70. FIG. 20 shows the fourteenth embodiment of the convertible tote bag assembled as a tote bag.

Figure 21:
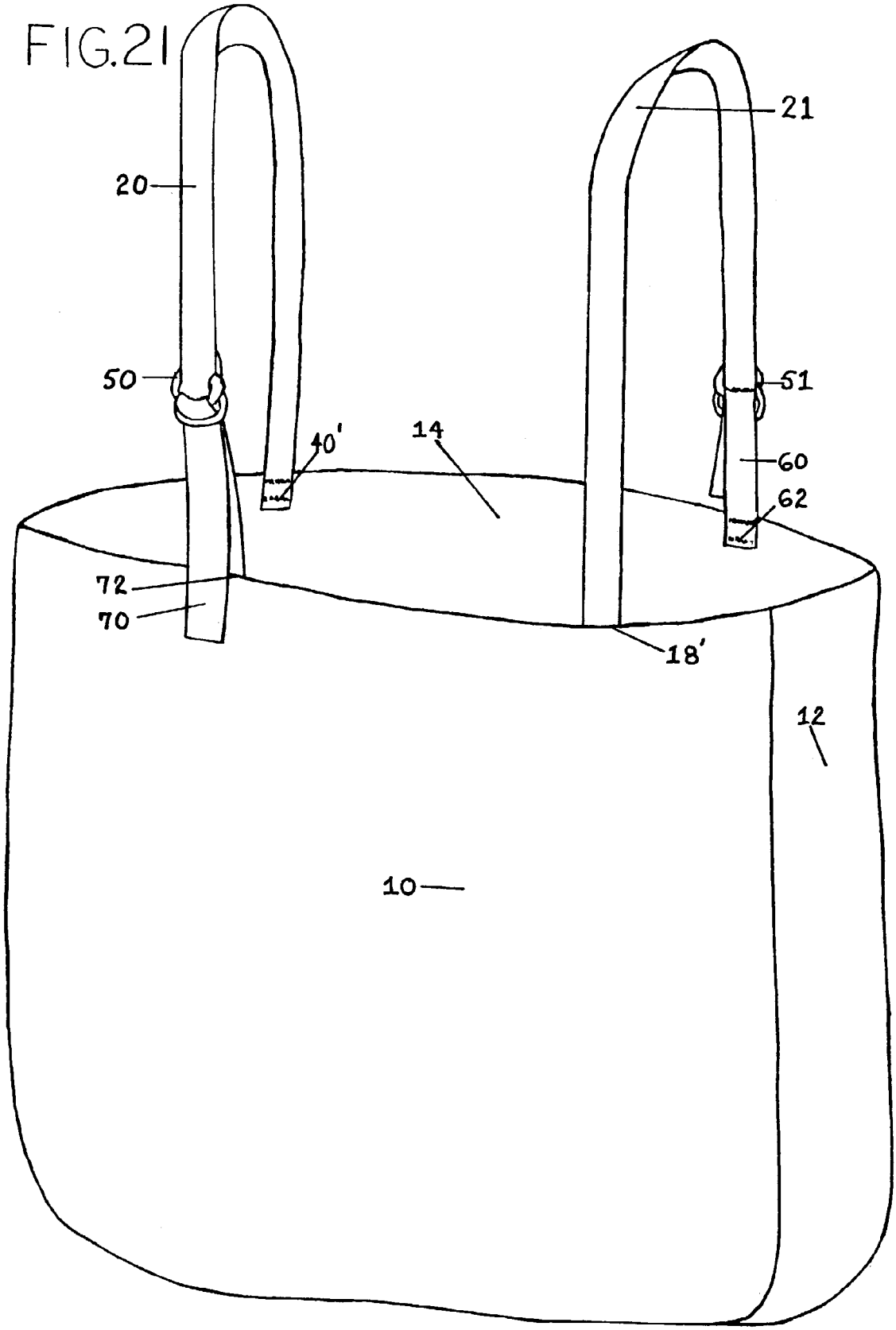
FIG. 21 is a view of the fourteenth embodiment of the convertible tote bag assembled as a backpack.

FIG. 21 shows the fourteenth embodiment of the convertible tote bag in which the front of the tote bag 10 has a strap 70 permanently attached to the top of the front of the tote bag 10 at position 72. This strap is used to selectively attach the D-rings 50 permanently affixed to the handle 20 that is permanently attached to the top of the back of the tote bag 14 at location 40'. The back of the tote bag 14 has a strap 60 permanently attached to the top of the back of the tote bag 14 at position 62. This strap is used to selectively attach the D-rings 51 permanently affixed to the handle 21 that is permanently attached to the top of the front of the tote bag 10 at position 18'. FIG. 21 shows the fourteenth embodiment of the convertible tote bag assembled as a backpack.

Figure 22:
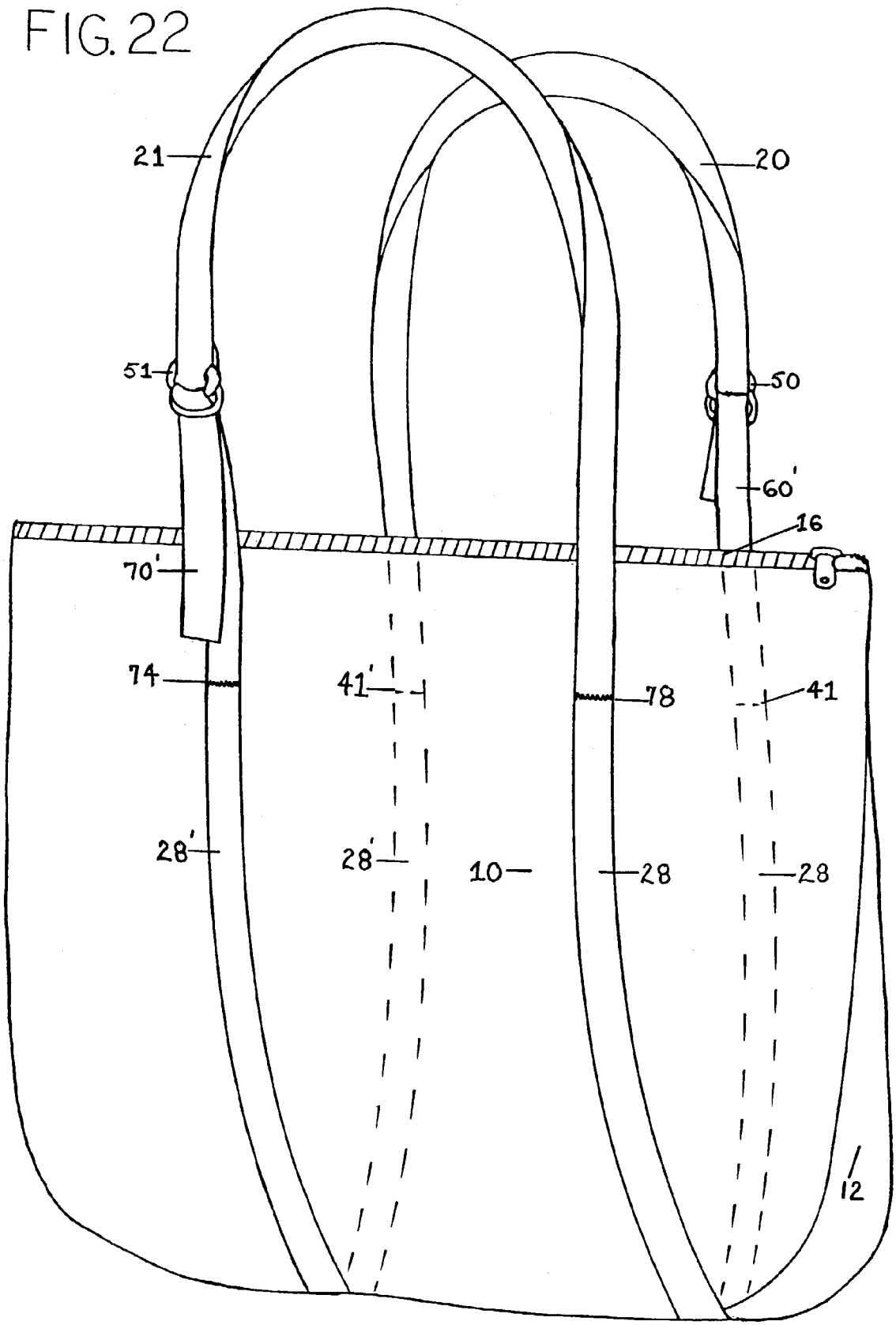
FIG. 22 is a view of the fifteenth embodiment of the convertible tote bag assembled as a bag.

FIG. 22 shows the fifteenth embodiment of the convertible tote bag as a closable bag in which the front of the tote bag 10 has an unattached segment 70' of the end portion of a strap of material 28' permanently attached to the front of the bag 10 ending at attachment 74. Strap of material 28' is permanently attached under the bag and on the back of the bag to position 41', at which point it extends freely from the top of the bag to become the handle 20. The section of the strap of material 28' from permanent attachment point 41' to the D-rings 50 attached at the end of the strap of material 28' is considered the free end of the strap (unnumbered). The section of the strap of material 28' from permanent attachment point 41' to the end of unattached segment 70' is considered the further end of the strap (unnumbered). Segment 70' is used to selectively attach the D-rings 51 permanently affixed to the handle 21 that is permanently attached to the top of the front of the tote bag 10 at position 78 located towards the opposite side of the top of the front of the tote bag 10 from the position 74. The back of the tote bag has a handle 20 to which D-rings 50 are permanently attached. An unattached segment of the strap of material 60' is used to selectively attach the D-rings 50 affixed to the handle 20. The section of the strap of material 28 from permanent attachment point 78 to the D-rings 51 attached at the end of the strap of material 28 is considered the free end of the strap (unnumbered). The section of the strap of material 28 from permanent attachment point 78 to the end of unattached segment 60' is considered the further end of the strap (unnumbered). Straps 60' and 70' allow for the length of the handles to be adjustable. The zipper 16 is permanently attached to front 10, sides 12 and back at the top of the bag. FIG. 22 shows the fifteenth embodiment of the present invention assembled as a tote bag.

FIG. 23 shows the fifteenth embodiment of the convertible tote bag in which the unattached segment of the strap of material 60' on the back of the tote bag is selectively attached to the handle 21 that is an unattached extension of the strap of material 28 permanently affixed to the back 14, bottom and front of the bag 10 to the position 78. The unattached segment of the strap of material 70' on the front of the tote bag 10 is selectively attached to the handle 20 that is an unattached extension of the strap of material 28' permanently affixed to the front 10, bottom and back of the bag. Straps 60' and 70' allow for the length of the handles to be adjustable. FIG. 23 shows the fifteenth embodiment of the convertible tote bag with an arrangement of the handles that makes loops that allow the handles to be worn over the shoulders and the tote bag to be worn as a backpack.

Figure 33:
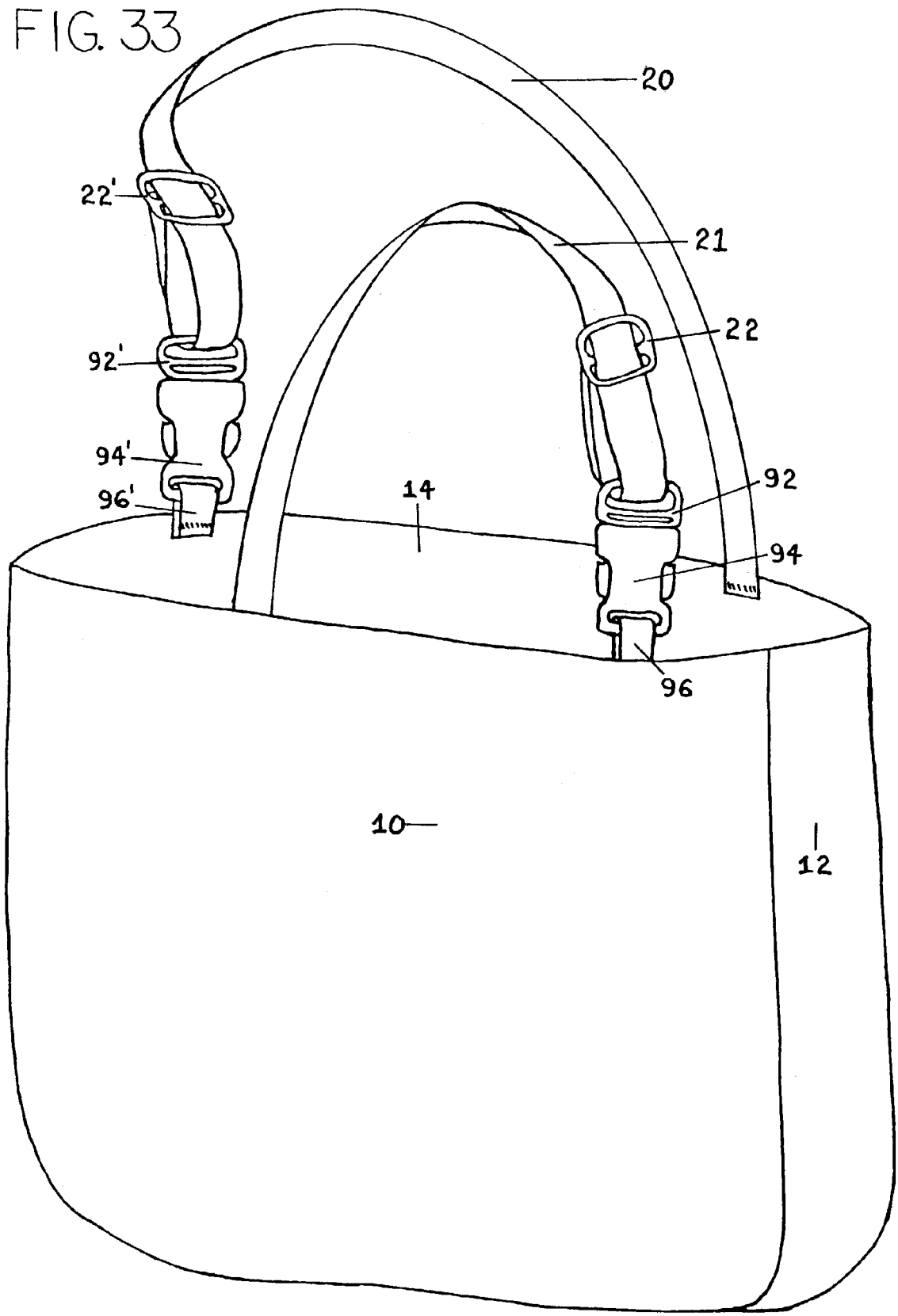
FIG. 33 is a view of the sixteenth embodiment of the convertible tote bag assembled as a bag.

FIG. 33 shows the sixteenth embodiment of the convertible tote bag of the present invention. In the sixteenth embodiment, the swivelhook attachment mechanism 24 of the first embodiment is replaced by the male segment 92 of the side release buckle 90. Male segment 92 is attached to handle 21 of the tote bag with slide mechanism 22 that allows the length of the handle to be adjusted. Female segment 94 of the side release buckle 90 is permanently attached with strap of material 96 to the inside of the top of the side 10 of the tote bag at the position of grommet 26 in the first embodiment. In the sixth embodiment, the same type of side release buckle 90 with strap of material 96 is used to replace swivelhook attachment mechanism 24' and grommet 42 of the first embodiment. The side release buckle 90 with strap of material 96 can be used to replace the swivelhook attachment mechanism and grommet in all the embodiments of the present invention in which the grommet is used. FIG. 33 shows the sixteenth embodiment assembled as a tote bag.

Figure 34:
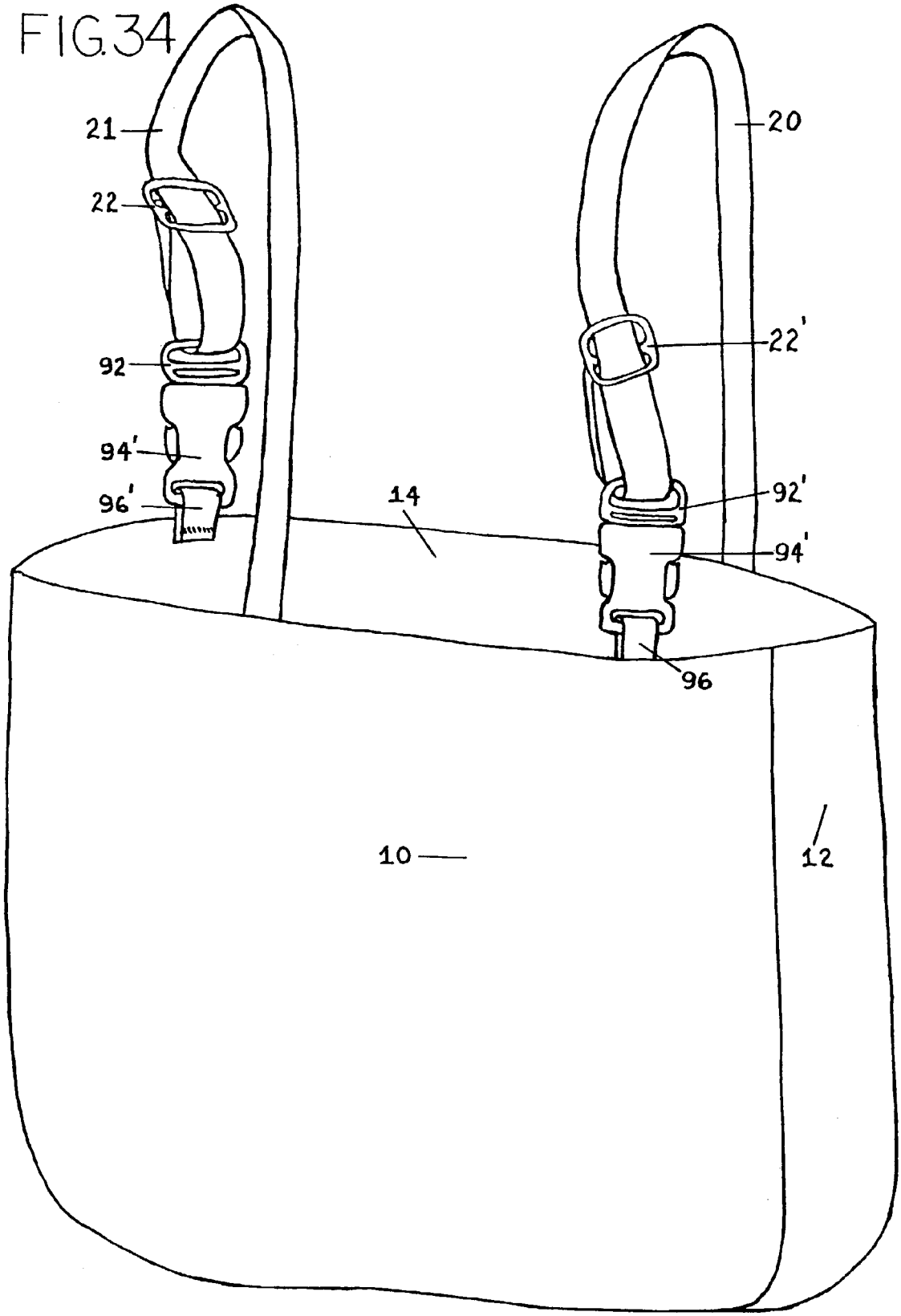
FIG. 34 is a view of the sixteenth embodiment of the convertible tote bag assembled as a backpack.

FIG. 34 shows the sixteenth embodiment of the present invention in which the male segment 92 of the side release buckle is selectively attached to the female segment 94' permanently attached to the inside top of the back of the side of the bag 14, and male segment 92' of the side release buckle is selectively attached to the female segment 94 permanently attached to the inside top of the front of the side of the bag 10. This arrangement of the handles makes loops that allow the handles to be worn over the shoulders and the tote bag to be worn as a backpack. FIG. 34 shows the sixteenth embodiment assembled as a backpack.

Figure 29:
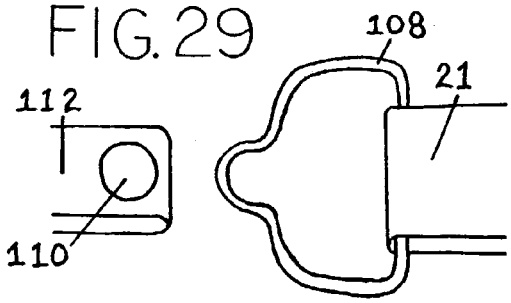
FIG. 29 is a view of a button loop and button with attachment straps.
Figure 30:
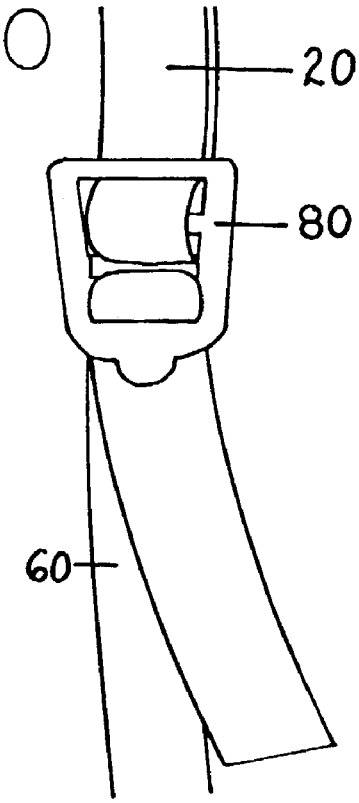
FIG. 30 is a view of a ladderloc with attachment straps.
Figure 31:
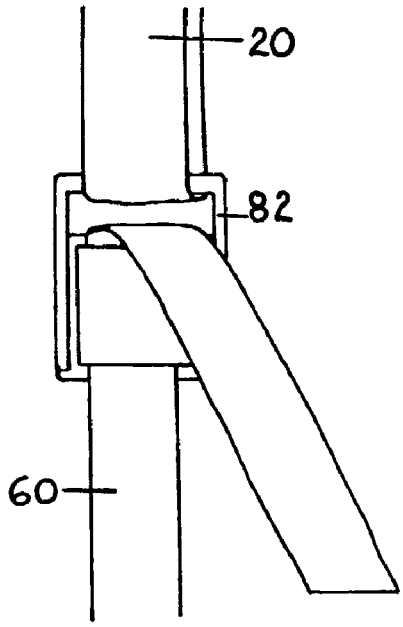
FIG. 31 is a first view of a cam with attachment straps.
Figure 32:
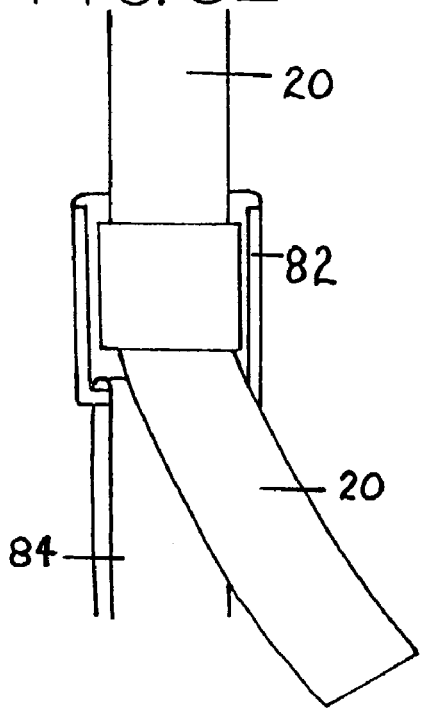
FIG. 32 is a second view of a cam with attachment straps.

The seventeenth embodiment of the present invention replaces the swivelhook attachment mechanism 24 of the first embodiment with the button loop 108 permanently attached to handle 21 as detailed in FIG. 29. The button 110 replaces the grommet 26 of the first embodiment. In the seventeenth embodiment, the button 110 can be attached directly to the outside of the top of the side 10 of the tote bag or it can be permanently attached to a strap of material 112 that is permanently attached to the same location. In the seventeenth embodiment, the same type of button loop 108 and button 110 is used to replace swivelhook attachment mechanism 24' and grommet 42, respectively, of the first embodiment. The button loop 108 and button 110, where button 110 is attached directly to the bag or to material strap 112, can be used to replace the swivelhook attachment mechanism and grommet in all the embodiments of the present invention in which the swivelhook and grommet are used.

Figure 35:
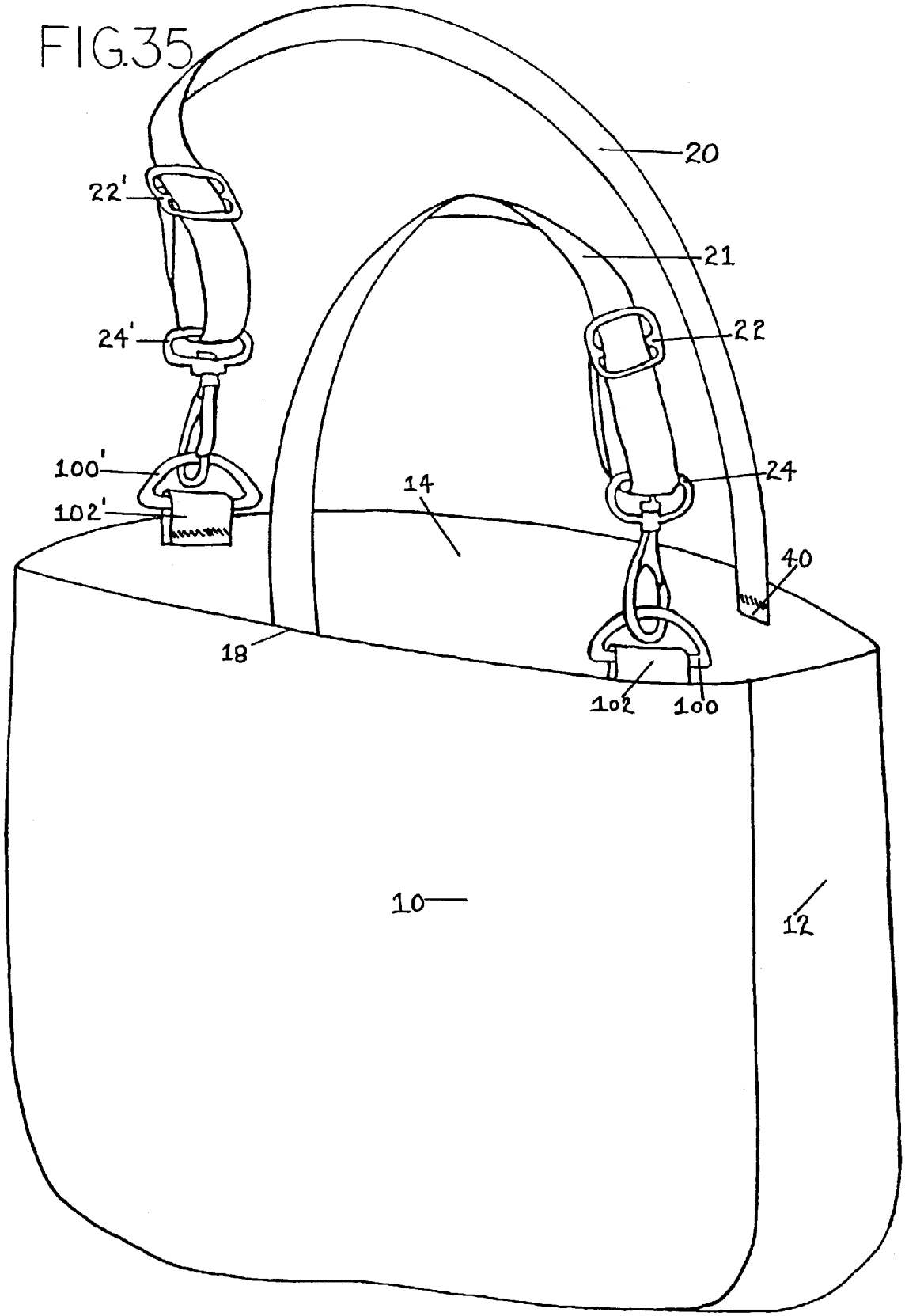
FIG. 35 is a view of the eighteenth embodiment of the convertible tote bag assembled as a bag.

FIG. 35 shows the eighteenth embodiment of the present invention in which the grommet 26 of the eleventh embodiment is replaced by a ring 100 and a strap of material 102. Ring 100 is permanently attached with strap of material 102 to the inside of the top of the side 10 of the tote bag at the position of grommet 26 in the eleventh embodiment. In the eighteenth embodiment, the same type of ring 100 with strap of material 102 is used to replace swivelhook attachment mechanism 24' and grommet 42 of the eleventh embodiment. The ring 100 with strap of material 102 can be used to replace the grommets in all the embodiments of the present invention in which the grommet is used. FIG. 35 shows the eighteenth embodiment assembled as a tote bag. As with the previous embodiments, the eighteenth embodiment can also be assembled as a backpack by interchanging the selective attachment of the handles via the swivelhook attachment mechanisms 24 and 24' in the rings 100 and 100'.

Figure 36:
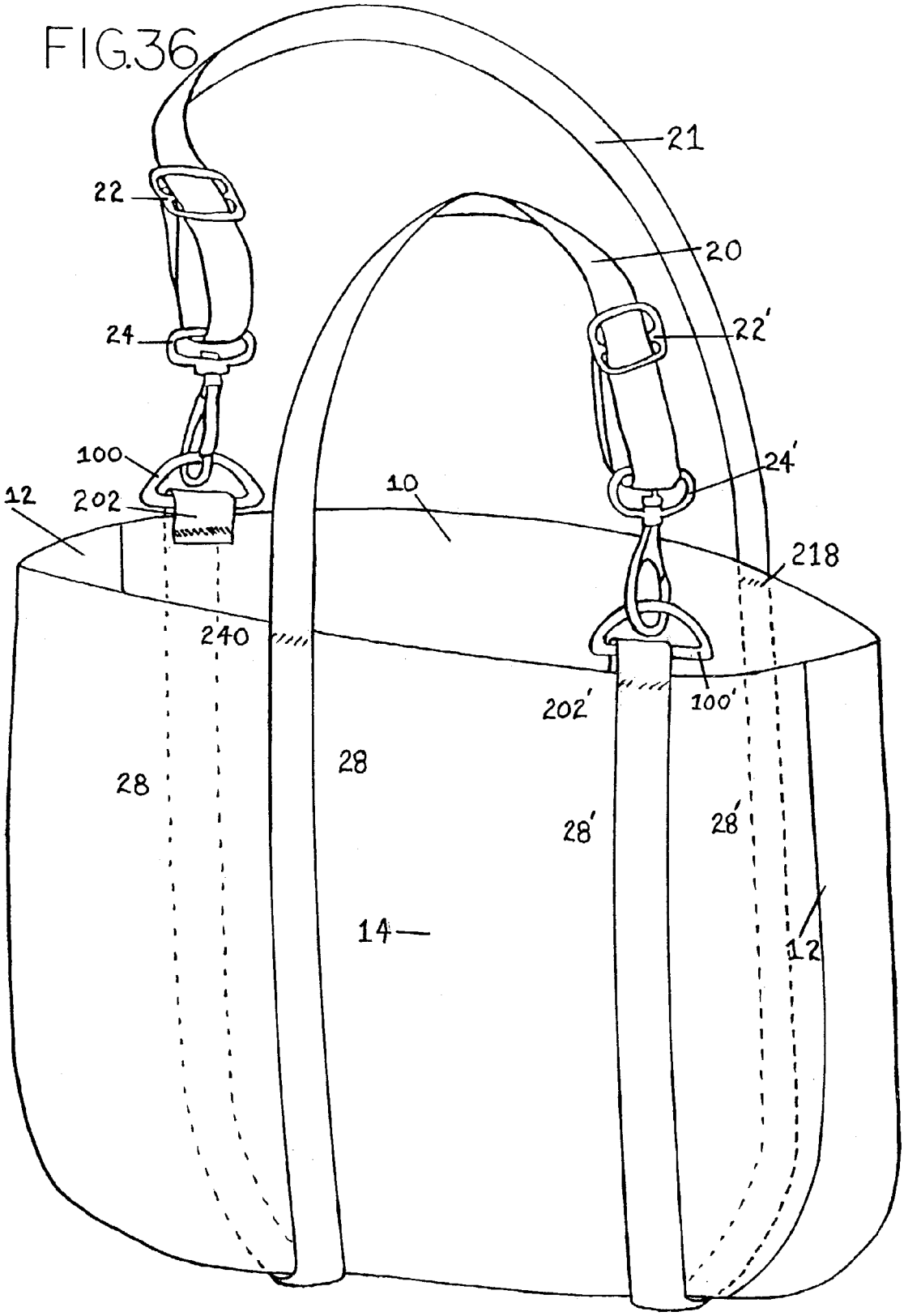
FIG. 36 is a view of the nineteenth embodiment of the convertible tote bag assembled as a bag.

FIG. 36 shows the nineteenth embodiment of the present invention as an open bag in which strap of material 28 permanently attaches ring 100 to the top of the front of the bag 10 at position 202 and is permanently attached to the outside of the front 10 of the bag from position 202 down the outside of the front 10 of the bag, across the outside of the bottom of the bag, and up the outside of the back 14 of the bag where it is permanently attached at position 240, at which point it extends freely from the top of the outside of the bag to become handle 20. The section of the strap of material 28 from permanent attachment point 240 to position 202 is considered the further end of the strap (unnumbered). The section of the strap of material 28 from permanent attachment point 240 to swivel hook 24' is considered the free end of the strap (unnumbered). Strap of material 28' permanently attaches ring 100' to the top of the back 14 of the bag at position 202' and is permanently attached to the outside of the back 14 of the bag from position 202' down the outside of the back 14 of the bag, across the outside of the bottom of the bag and up the outside of the front 10 of the bag where it is permanently attached to the top of the outside of the front 10 of the bag at position 240, at which point it extends freely from the top of the outside of the bag to become handle 21. The section of the strap of material 28' from permanent attachment point 218 to position 202' is considered the further end of the strap (unnumbered). The section of the strap of material 28' from permanent attachment point 218 to swivel hook 24 is considered the free end of the strap (unnumbered). These strap of material can be made of a wide variety of materials, including, but not limited to, fabric, webbing, leather, plastic or various synthetic fabrics. FIG. 36 shows the nineteenth embodiment of the present invention assembled as a tote bag.

The nineteenth embodiment can be assembled as a backpack in the same manner as the eleventh embodiment as shown in FIG. 15, where the two handles are positioned to form two loops that selectively attach to the opposite sides of the tote bag, thus allowing the handles to be worn over the shoulders and the tote bag to be worn as a backpack.

Figure 37:
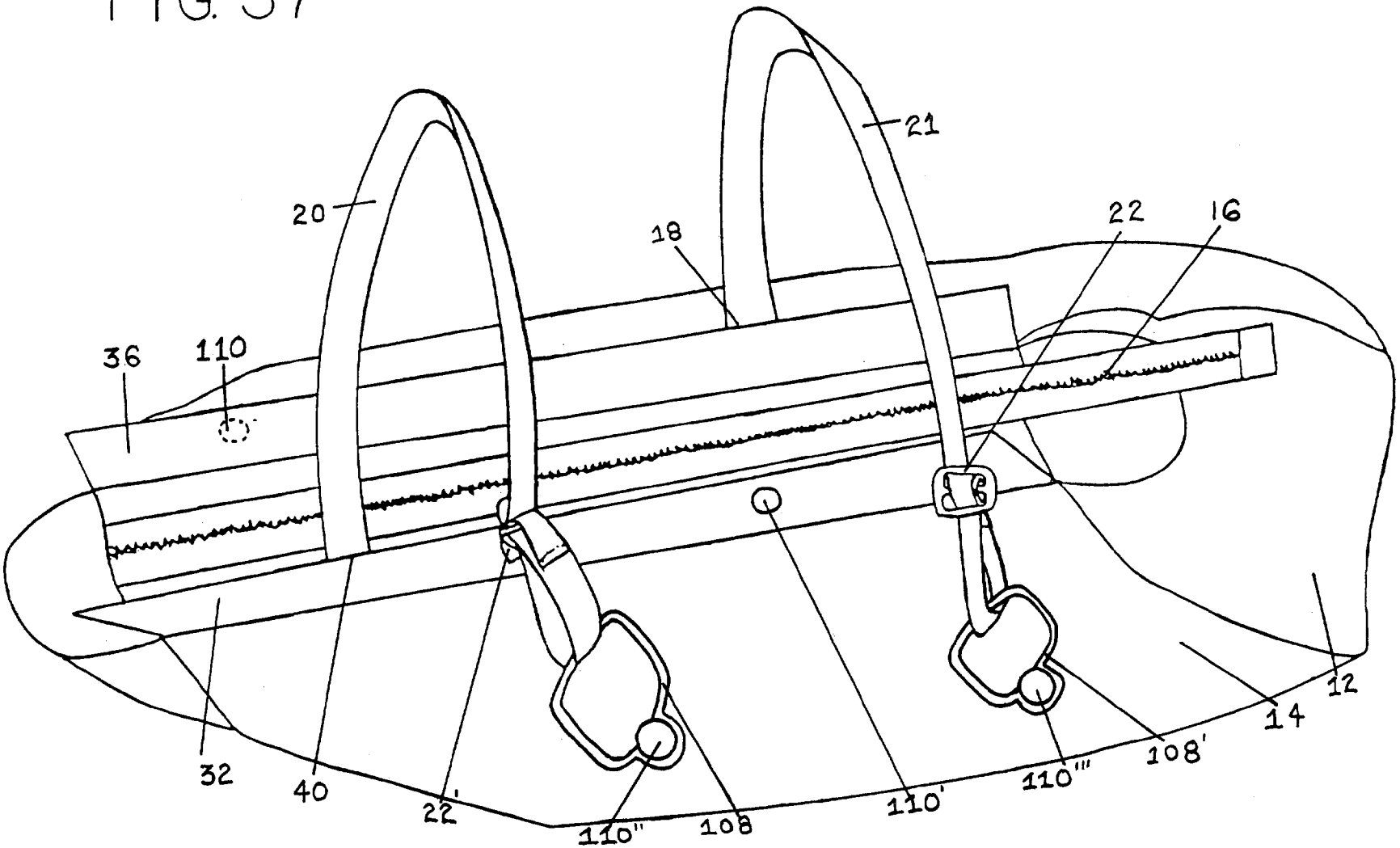
FIG. 37 is a view of the twentieth embodiment of the convertible tote bag assembled as a backpack.

FIG. 37 shows the twentieth embodiment of the present invention of the present invention assembled as a backpack in a different manner than the thirteenth embodiment, although the twentieth embodiment can be assembled as a backpack in the same manner as the thirteenth embodiment as well. The twentieth embodiment is the same as the thirteenth embodiment shown in FIG. 18 and FIG. 19 with two differences. First, grommets 26 and 42 are replaced with buttons 110 and 110'. Second, button 110''' is permanently affixed in the position on the back 14 of the tote bag at the bottom of the tote bag underneath the button 110' permanently attached to the outside of the upward extension of the top of the bag 32, and another button 110'' is permanently attached to the bottom of the back 10 of the tote bag underneath permanent attachment 40 of handle 20 at the inside of the top of the upward extension 32 of the back 14 tote bag. Button loop 108' on handle 21 is selectively attached to button 110''' and button loop 108 on handle 20 is selectively attached to button 110''. The two handles are positioned to form two loops that selectively attach to the bottom of the back 10 of the tote bag, thus allowing the handles to be worn over the shoulders and the tote bag to be worn as a backpack. The combination of replacing grommets 26 and 42 in all the embodiments of the invention that have closed tops and that use grommets with buttons 110 and 110', respectively, combined with the addition of buttons 110'' and 110''' in all these embodiments makes it possible for all these embodiments to be worn as backpacks with the handles forming two loops that attach to the bottom of the tote bag.

Instead of button loops 108 and 108' and slider 22' and 22 on handles 20 and 21, handles 20 and 21 can have a series of button holes permanently affixed in them. These button holes can be used to selectively attach handles 20 and 21 to buttons 110 and 110' or 110'' and 110'''.

Figure 38:
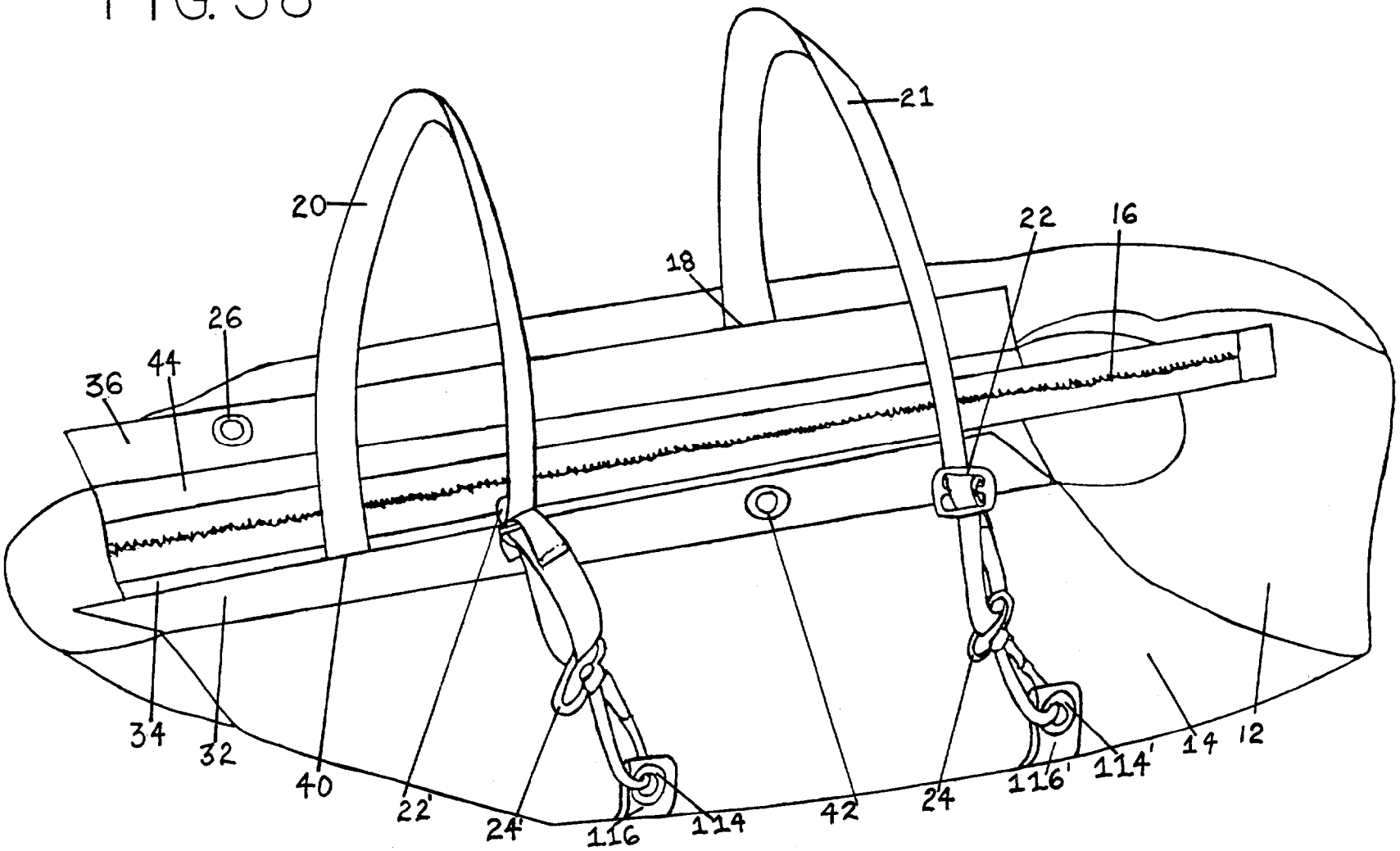
FIG. 38 is a view of the twenty-first embodiment of the convertible tote bag assembled as a backpack.

FIG. 38 shows the twenty-first embodiment of the present invention. FIG. 38 shows the twenty-first embodiment of the present invention assembled as a backpack in a different manner than the thirteenth embodiment, although the twenty-first embodiment can be assembled as a backpack in the same manner as the thirteenth embodiment as well. The twenty-first embodiment is the same as the thirteenth embodiment shown in FIG. 18 and FIG. 19 with one difference. In the twelfth embodiment, strap of material 116' with grommet 114' permanently affixed in it is permanently affixed in the position on the back 14 of the tote bag at the bottom of the tote bag underneath the grommet 42 permanently affixed to the upward extension 32 of top of the back bag 14, and another strap of material 116 with grommet 114 permanently affixed in it is permanently attached to the bottom of the back 14 of the tote bag underneath permanent attachment 40 of handle 20 at the inside top of the upward extension 32 of the back of the tote bag 36. Swivelhook attachment 24 on handle 21 is selectively attached to grommet 114' and swivelhook attachment 24' on handle 20 is selectively attached to grommet 114'. The two handles are positioned to form two loops that selectively attach to the bottom of the back 14 of the tote bag, thus allowing the handles to be worn over the shoulders and the tote bag to be worn as a backpack. The permanent attachment of grommets 114 and 114' at the bottom of the tote bag in all the embodiments of the invention that have closed tops and use swivelhook or snaphook attachment mechanisms at the end of handles 20 and 21 makes it possible for all these embodiments to be worn as backpacks with the handles forming two loops that attach to the bottom of the tote bag.

The permanent attachment of two of the devices for cooperating with the element which releasably attaches handles 20 and 21 in all the embodiments of the invention that have closed tops makes it possible for all these embodiments to be worn as backpacks with the handles forming two loops that attach to the bottom of the tote bag.

Figure 39:
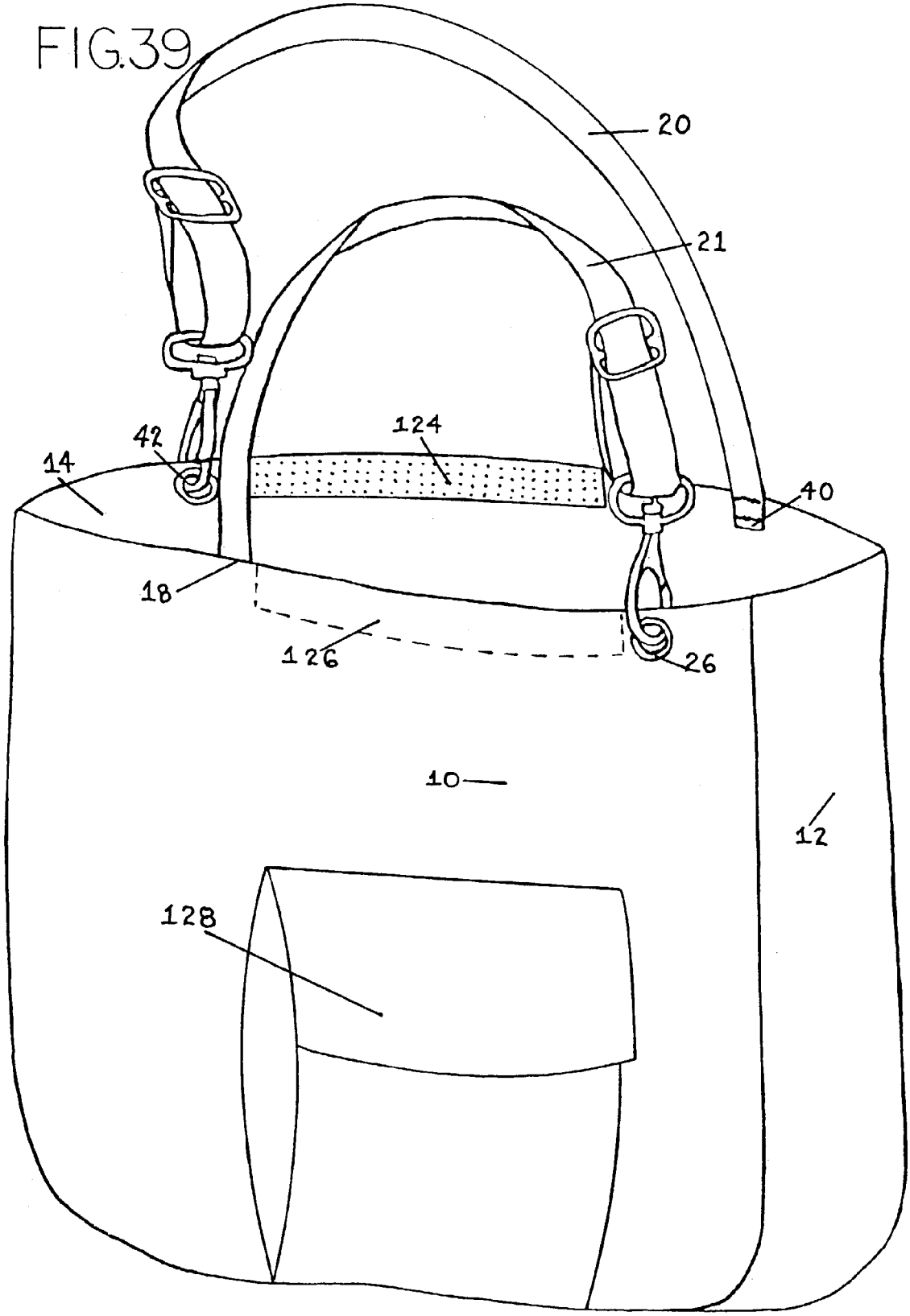
FIG. 39 is a view of the eleventh embodiment of the convertible tote bag with a velcro closure at the top and an outside pocket on the front.

FIG. 39 is a view of the eleventh embodiment of the convertible tote bag with a hook and loop closure at the top and an outside pocket on the front. Hook adhering material 124 extends along the inside top edge of the back 14 permanently affixed between grommet 42 and permanent attachment 40 of handle 20. Loop adhering material 126 extends along the inside top edge of the front 10 permanently affixed between grommet 26 and permanent attachment 18 of handle 21. This type of top closure can be used to make all the embodiments of the present invention with open tops into closable tops. It can replace a zipper in those embodiments with closable tops that are shown with a zipper. Pocket 128 is shown permanently attached to the outside front 10 of the convertible tote bag of the present invention. Pocket 128 can also be permanently attached to the inside of the back 14 of the convertible tote bag. It can be closed with a the full range of closures know in the art of making bags, including, but not limited to, latches, hook and loop tape, button loops and buttons, and side release buckles. Pocket 128 can be used with all of the embodiments of the present invention, permanently affixed to either the outside or the inside of the convertible tote bag.

FIG. 40 is a view of the fifteenth embodiment of the convertible tote bag with a flap closure **14*a* at the top of the tote bag secured by a standard latch bag closure 140. The flap closure can be selectively secured with a the full range of closures know in the art of making bags, including, but not limited to, latches, hook and loop tape, button loops and buttons, and side release buckles. In this view, the flap closure 14*a* is an extension of the back of the back that extends over the top of the bag inside strap of material 70' and handle 21 to the position where strap of material 70' is permanently attached 74 to the front of the bag 10 and handle 21 is permanently attached to the front of the bag 78**. This type of top closure can be used with all the embodiments of the present invention in which straps of material are permanently attached part of the way up the front and back of the tote bag, then extending freely from the bag. It would replace the zipper in those embodiments that use a zipper.

FIG. 41 is a view of the fifteenth embodiment of the convertible tote bag with a drawstring closure 132. The drawstring 138 extends through the opening 136 in the drawstring closure 132 at the top of the tote bag. The length of the drawstring can be adjusted by the use of cord closure 134. This type of closure can be used with all the embodiments of the present invention. It would replace the zipper in those embodiments that use a zipper.

I claim:

1. A tote bag convertible to a backpack, said bag having front, back, and side walls connected to a bottom wall and defining a compartment having a top, said bag further including an adjustable carrying apparatus which allows the bag to be converted to a backpack, comprising:

first and second straps, the first and second straps including means for adjusting their lengths, the first and second straps each being permanently attached to one of the front or back walls near the top at points that are diagonally opposite each other and having a free end, the free ends of the first and second straps each having a releasable element which releasably attaches each strap to one of the front or back walls near the top at points that are diagonally opposite each other, each front and back wall including a means for cooperating with each releasable element for releasably attaching the free ends of the first and second straps to one of the front or back walls, the means for cooperating with each releasable element being diagonally opposite each other and opposite the permanently attached points, the back wall including two securement devices for cooperating with each releasable element for releasably attaching the free ends of the first and second straps to the back wall, one of the two securement devices being affixed to the back wall near the bottom thereof at a point that is below the permanent attachment point of the first strap near the top, and the other of the two securement devices being affixed to the back wall near the bottom thereof at a point that is below the means for cooperating with each element for releasably attaching the free ends of the first and second straps near the top, whereby the first strap is permanently affixed near the top of the back wall and its free end can be can be threaded through the means for cooperating with each releasable element located near the top of the front wall such that the free end of the first strap extends over the top of the bag and down the back wall to releasably attach to one of the two securement devices for cooperating with the releasable element for releasably attaching the free end of the first strap affixed near the bottom of the back wall, and whereby the second strap is permanently affixed near the top of the front wall and its free end can be threaded through the means for cooperating with each releasable element located near the top of the back wall such that the free end of the second strap extends down the back wall to releasably attach to one of the two securement devices for cooperating with the releasable element for releasably attaching the free end of the second strap affixed near the bottom of the back wall, whereby the free end of each of the first and second straps may be attached to the same bag wall to form a pair of carrying handles or to one of the opposite bag walls and near the bottom of the back of the bag wall to form shoulder straps.

2. The tote bag of claim 1 wherein the first and second straps are made of material chosen from the group comprising fabric, webbing, plastic, leather and synthetic material, whereby the first strap has a further end extending from the permanent attachment point near the top of the bag which is permanently attached to the bag as the further end of the first strap extends down the back wall, threads through one of the two securement devices and attaches the securement device to the back wall near the bottom thereof, extends across the bottom wall and vertically up the front wall wherein the further end of the first strap attaches the means for cooperating with each releasable element near the top of the front wall, whereby the second strap has a further end extending from the permanent attachment point near the top of the bag which is permanently attached to the bag as the further end of the second strap extends down the front wall, across the bottom wall, and vertically up the back wall wherein the further end of the second strap threads through one of the two securement devices and attaches the securement device to the back wall near the bottom thereof, and extends up the back wall wherein it the further end of the second strap attaches the means for cooperating with each releasable element near the top of the back wall.

3. The tote bag of claim 1 wherein each releasable element which releasably attaches the free end of the first and second straps is chosen from the group comprising a swivelhook and snaphook and each securement device for cooperating with each releasable element for releasably attaching the free end of the first and second straps to the front or back wall is chosen from the group comprising a grommet and rings and D-rings permanently attached with straps.

4. The tote bag of claim 1 wherein the compartment has an open top.

5. The tote bag of claim 4 wherein the first and second straps are made of material chosen from the group comprising fabric, webbing, plastic, leather and synthetic material, whereby the first strap has a further end extending from the permanent attachment point near the top of the bag which is permanently attached to the bag as the further end of the first strap extends down the back wall, threads through one of the two securement devices and attaches the securement device to the back wall near the bottom thereof, extends across the bottom wall and vertically up the front wall wherein the further end of the first strap attaches the means for cooperating with each releasable element near the top of the front wall, whereby the second strap has a further end extending from the permanent attachment point near the top of the bag which is permanently attached to the bag as it extends down the front wall, across the bottom wall, and vertically up the back wall wherein the further end of the second strap threads through one of the two securement devices and attaches the securement device to the back wall near the bottom thereof, and extends up the back wall wherein the further end of the second strap attaches the means for cooperating with each releasable element near the top of the back wall.

6. The tote bag of claim 4 wherein each element which releasably attaches the free end of the first and second straps is chosen from the group comprising a swivelhook and snaphook and each securement device for cooperating with each releasable element for releasably attaching the free end of the first and second straps to the front or back wall is chosen from the group comprising a grommet and rings and D-rings permanently attached with straps.

7. The tote bag of claim 1 wherein the compartment has a mechanism for closing the top.

8. The tote bag of claim 7 wherein the first and second straps are made of material chosen from the group comprising fabric, webbing, plastic, leather and synthetic material, whereby the first strap has a further end extending from the permanent attachment point near the top of the bag which is permanently attached to the bag as the further end of the first strap extends down the back wall, threads through one of the two securement devices to attach the securement device to the back wall near the bottom thereof, extends across the bottom wall and vertically up the front wall wherein the further end of the first strap attaches the means for cooperating with each releasable element near the top of the front wall, whereby the second strap has a further end extending from the permanent attachment point near the top of the bag which is permanently attached to the bag as the further end of the second strap extends down the front wall, across the bottom wall, and vertically up the back wall wherein it the further end of the second strap threads through one of the two securement devices to attach the securement device to the back wall near the bottom thereof, and extends up the back wall wherein it attaches the means for cooperating with each releasable element near the top of the back wall.

9. The tote bag of claim 8 wherein the mechanism for closing the top is chosen from one of the following: zipper, hook and loop material, drawstring with cord closure, and flap closure with a closure mechanism chosen from the group comprising a latch, and hook and loop material.

10. The tote bag of claim 7 wherein each releasable element which releasably attaches the free end of the first and second straps is chosen from the group comprising a swivelhook and snaphook and each securement device for cooperating with each releasable element for releasably attaching the free end of the first and second straps to the front or back wall is chosen from the group comprising a grommet and rings and D-rings permanently attached with straps.

11. The tote bag of claim 7, said front and back walls having upward extensions extending above the mechanism for closing the top, whereby the first and second straps are permanently attached to the upward extension of one of the front or back walls at points that are diagonally opposite each other, the upward extension of each front and back wall including the means for cooperating with each element for releasably attaching the free ends of the first and second straps to one of the front or back walls, the means for cooperating with each element being diagonally opposite each other and opposite the permanently attached points, whereby the free end of each of the first and second straps may be attached to the upward extension of the same bag wall to form a pair of carrying handles or to one of the upward extension of the opposite bag walls and near the bottom of the back of the bag wall to form shoulder straps.

12. The tote bag of claim 11 wherein each releasable element which releasably attaches the free end of the first and second straps is chosen from the group comprising a swivelhook and snaphook and each securement device for cooperating with each releasable element for releasably attaching the free end of the first and second straps to the front or back wall is chosen from the group comprising a grommet and rings and D-rings permanently attached with straps.

13. The tote bag of claim 11 wherein the mechanism for closing the top is chosen from one of the following: zipper, hook and loop material, drawstring with cord closure, and flap closure with a closure mechanism chosen from the group comprising a latch, and hook and loop material.

14. The tote bag of claim 7 wherein the mechanism for closing the top is chosen from one of the following: zipper, hook and loop material, drawstring with cord closure and flap closure with a closure mechanism chosen from the group comprising a latch, and hook and loop material.

* * * * *